US005842087A

United States Patent [19]

Matsushita et al.

[11] Patent Number: 5,842,087

[45] Date of Patent: Nov. 24, 1998

[54] CHARGING DEVICE FOR IMAGE FORMING APPARATUS

[75] Inventors: Kouji Matsushita; Yasuhiro Nakagami; Futoshi Okazaki, all of Osaka, Japan

[73] Assignee: Minolta Co., Ltd., Osaka, Japan

[21] Appl. No.: 879,329

[22] Filed: Jun. 20, 1997

Related U.S. Application Data

[63] Continuation-in-part of Ser. No. 671,879, Jun. 28, 1996, Pat. No. 5,787,327.

[30] Foreign Application Priority Data

| | | | |
|---|---|---|---|
| Jun. 30, 1995 | [JP] | Japan | 7-166596 |
| May 14, 1996 | [JP] | Japan | 8-119221 |
| Aug. 12, 1996 | [JP] | Japan | 8-212232 |
| Aug. 12, 1996 | [JP] | Japan | 8-212233 |

[51] Int. Cl.[6] ..... G03G 15/02

[52] U.S. Cl. ..... 399/174

[58] Field of Search ..... 399/50, 168, 174, 399/175, 176

[56] References Cited

U.S. PATENT DOCUMENTS

| | | | |
|---|---|---|---|
| 4,233,611 | 11/1980 | Nakano et al. . | |
| 5,177,534 | 1/1993 | Kisu et al. | 399/168 |
| 5,278,614 | 1/1994 | Ikegawa et al. . | |
| 5,307,122 | 4/1994 | Ohno et al. | 399/174 |
| 5,321,472 | 6/1994 | Adachi et al. | 399/174 |
| 5,376,995 | 12/1994 | Yamamoto et al. | 399/174 |
| 5,402,213 | 3/1995 | Ikegawa et al. | 399/174 |
| 5,471,283 | 11/1995 | Irihara et al. | 399/168 X |
| 5,701,551 | 12/1997 | Honda et al. | 399/50 |

FOREIGN PATENT DOCUMENTS

| | | |
|---|---|---|
| 57-26863 | 2/1982 | Japan . |
| 59-87180 | 5/1984 | Japan . |
| 60-49962 | 3/1985 | Japan . |

*Primary Examiner*—Sandra L. Brase
*Attorney, Agent, or Firm*—McDermott, Will & Emery

[57] ABSTRACT

A charging device K is provided with a flexible electrode 12 and a flexible intermediate member M disposed between the flexible electrode 12 and a charge-receiving member 10, with the flexible intermediate member M being in contact with the charge-receiving member 10. The flexible intermediate member M includes a flexible insulated member 11 and semiconductive member 14 so as to charge the charge-receiving member 10 via a discharge from electrode 12. The absolute value of the difference between the potential of the flexible electrode 12 during discharge and the potential in the vicinity of at least the area of discharge of the flexible electrode 12 among areas in which the flexible intermediate member is in contact with the charge-receiving member 10, is less than the absolute value of the difference between the potential of the charge-receiving member and the potential of the flexible electrode during discharge.

26 Claims, 19 Drawing Sheets

CHARGING DEVICE FOR IMAGE FORMING APPARATUS

CROSS-REFERENCE TO RELATED APPLICATION

This is a continuation-in-part of application Ser. No. 08/671,879, filed Jun. 28, 1996, now U.S. Pat. No. 5,787, 327.

BACKGROUND OF THE INVENTION

The present invention relates to a charging device for charging a charge-receiving member, such as a dielectric member, a photoconductive member, a paper, or the like. More specifically, the present invention relates to a charging device for use in image forming apparatuses, which is capable of uniformly charging a charge-receiving member without charging defects such as irregular charging and the like, so as to provide excellent images. Furthermore, the present invention also relates to a charging device for an image forming apparatuses of the electrophotographic type, wherein an electrostatic latent image is directly formed on a recording member, such as a paper sheet or the like via a charging device. The latent image is developed as a visible toner image, which is then fused to the sheet, or an electrostatic latent image is formed on a latent image bearing member, such as a latent image recording belt, photosensitive drum or the like via a charging device. The latent image is developed as a toner image, which is then transferred onto a recording member and fused thereon for such devices as copiers, printers, and facsimile machines. The electrostatic latent image is formed on a charging member where it is developed as a toner image and directly displayed.

Heretofore, in the field of charging devices for image forming apparatuses, U.S. Pat. No. 4,223,611 discloses flexible wire electrodes arranged in parallel and covered by a flexible insulating member. A part of the flexible insulating member is pressed at an inclination against a charge-receiving member so as to maintain a uniform spacing between the charge-receiving member and the wire electrodes in contact therewith.

Japanese Unexamined Laid-Open Patent No. SHO 60-49962 discloses one type of charging device, wherein a thin part is formed on the side opposite a charge-receiving member of a baseplate edge of a recording head comprising, a print substrate on which is formed a multi-stylus head electrode, the thin part being provided with a reinforming member having a high degree of flatness and extending perpendicular to the multi-stylus head so as to maintain a uniform distance between each electrode and the charge-receiving member (recording member).

Japanese Unexamined Laid-Open Patent No. SHO 59-87180 discloses a process wherein the neck of an electrostatic recording head is covered by a reinforcement tape. Then the neck of the recording head receives a liquid application of spacer material, after which the reinforcement tape is removed to expose the head, such that the spacer formed of the spacer material maintains a predetermined spacing between the head and a charge-receiving member.

U.S. Pat. No. 5,278,614 discloses a charging film (electrode film) covered with an electrically insulated layer at a part in contact with a charge-receiving member. Although the charging film disclosed in U.S. Pat. No. 5,278,614 conforms to the surface irregularities and undulations of a charging member, discharging occurs from the electrode film to the electrically insulated layer through friction charging in accordance with the materials selected for the charge receiving member and electrical insulation layer on the film in contact with the charge receiving member, thereby causing poor printing.

Furthermore, in the case of U.S. Pat. No. 5,278,614, the charging film is easily lifted by the airflow generated via the movement and rotation of the charge-receiving member, such that a uniform distance cannot be maintained between the electrode and charge-receiving member, which leads to irregularities of the electrostatic potentials resulting in irregular density and fog.

Japanese Unexamined Laid-Open Patent No. SHO 57-26863 discloses an electrostatic recording head having discharge electrodes embedded in an insulated support member, which is provided with an insulated spacer at locations other than the discharge electrodes on a discharge endface (recording face) at which the electrodes are exposed to maintain the distance between the surface of the charge-receiving member and the discharge electrodes via contact of the insulated spacer with the charge-receiving member, and wherein friction charging is prevented by having the material of the spacer identical to the material of the surface of the charge-receiving member, and wherein the appearance of ghost images caused by friction charging is prevented. This electrostatic recording head cannot adequately conform to the surface irregularities and undulations of the charge receiving member, thereby causing printing irregularities due to the irregular charging potential of the surface of the charge receiving member. As a result, print defects arise due to the charging irregularities of the surface of the charge-receiving member in the same manner as the charging devices of Japanese Unexamined Laid-Open Patent Nos. 60-49962 and 59-87180.

In the charging device disclosed in U.S. Pat. No. 4,223, 611, a part of the flexible insulated member is pressed against the charge-receiving member at an inclination so as to maintain a uniform spacing between the wire electrodes and charge-receiving member while the flexible insulated member is in contact with the charge-receiving member. As a result, the flexible insulated member and wire electrodes readily conform to the surface irregularities and undulations of the charge-receiving member while maintaining a uniform distance between the wire electrodes and the charge-receiving member. However, in this charging device (U.S. Pat. No. 4,223,611), sufficient conformity to the surface irregularities and undulations of the charge-receiving member cannot be obtained when the flexible insulated member is thick and hard. It becomes necessary for the flexible insulated member to be rendered thinner and malleable so as to achieve conformity with the surface irregularities and undulations of the charge-receiving member. However, when made thinner and more malleable, the flexible insulated member cannot be adequately positioned, such that ultimately adequate conformity to the surface irregularities and undulations of the charge-receiving member cannot be obtained. Furthermore, the flexible wire electrodes covered by the flexible insulating member are buffeted upward by the air pressure produced by the movement and rotation of the charge-receiving member, such that a uniform distance cannot be maintained between the electrodes and the charge receiving member, thereby causing printing irregularities due to irregular charging potentials.

Moreover, discharging of the electrode to the flexible insulated member occurs due to friction charging between the flexible insulated member and the charge receiving member in accordance with the type of material used, thereby producing poor printing.

In the description of the preferred embodiments of the above mentioned U.S. Pat. No. 4,223,611, it is stated that the flexible insulated member is formed of urethane rubber and that the charge receiving member is formed of a two-pack type polyurethane, such that when the materials specified in this system are used, electrostatic adhesion of the flexible insulated member to the charge receiving member via friction charging cannot be expected.

Furthermore, the conventional charging devices disclosed in Japanese Unexamined Laid-Open Patent Nos. 60-49962 and 59-87180 are not advantageous inasmuch as the relative hardness of the reinforcing member, print substrate, electrostatic recording head, and spacer prevent sufficient conformity to the undulations and surface irregularities of the charge-receiving member, such that a sufficiently uniform distance cannot be maintained between the electrodes and charge-receiving member, thereby causing print irregularities due to uneven charging of the surface of the charge-receiving member.

In the device disclosed in U.S. Pat. No. 4,223,611, the entire body of a flexible insulated member is inclined and pressed against a charge-receiving member so as to maintain a gap between the electrodes and the charge-receiving member, while part of the flexible insulated member is in contact with the charge-receiving member. This flexible insulated member and electrodes readily conform to the undulations and surface irregularities of the charge-receiving member so as to maintain a uniform distance between the electrode and charge-receiving member compared to the charging devices disclosed in Japanese Unexamined Laid-Open Patent Nos. 60-49962 and 59-87180. However, this charging device also requires that the flexible insulated member be thin and malleable so as to conform to the undulations and surface irregularities of the charge-receiving member because the conformity cannot be sufficiently obtained when the flexible insulated member is thick and hard. Thus, the flexible wire electrodes cannot be adequately positioned relative to the recording member, and as a result, there is insufficient conformity to the undulations and surface irregularities of the charge-receiving member. Furthermore, the flexible wire electrodes covered by the flexible insulated member are lifted up by the airflow generated by the movement and rotation of the charge-receiving member so as to cause an uneven separation distance between the electrode and charge-receiving member, and print defects due to uneven potential.

An object of the present invention is to provide a charging device which is capable of excellent charging the charge-receiving member. The other object of the present invention is to provide a charging device which can reduce undesired charging. Further, the other object of the present invention is to provide a charging device for image forming apparatuses which is capable of uniformly charging a charge receiving member by suppressing inadequate charging such as non-uniform charging, so as to be capable of producing excellent images by suppressing irregular printing and poor printing.

BRIEF DESCRIPTION OF THE INVENTION

To achieve at least one of above mentioned objects, the charging device of the present invention comprising:

an intermediate member for contacting the surface of the charge-receiving member; said intermediate member provided with an electrode for discharge to the charge-receiving member, and at least a part of the intermediate member being located between the electrode and the surface of the charge-receiving member to provide a gap therebetween.

The intermediate member may have a first surface for contacting the surface of the charge-receiving member and a second surface located downstream of the intermediate member at which the tip of the electrode is located. The charge-receiving member is charged to a first polarity by contacting with the first surface. In this case, the charging device may have a voltage source for applying electrical voltage having a second polarity oppose to the first polarity to the electrode.

The intermediate member may be made of a material of which a rank of triboelectric series is different from that of the charge-receiving member so that the charge-receiving member charges to a first polarity and the intermediate member charges to a second polarity oppose to the first polarity. In this case, the charging device may have a voltage source for applying electrical voltage having a second polarity oppose to the first polarity to the electrode.

The absolute value of the difference between the potential of the electrode during the voltage application and the potential of the intermediate member may be less than the absolute value of the difference between the potential of the charge-receiving member and the potential of the electrode during the voltage application.

The invention itself, together with further objects and attendant advantages, will best be understood by reference to the following detailed description taken in conjunction with the accompanying drawing.

DETAILED DESCRIPTION OF THE INVENTION

The preferred embodiments of the present invention are described hereinafter with reference to the accompanying drawings.

Figure 1A:
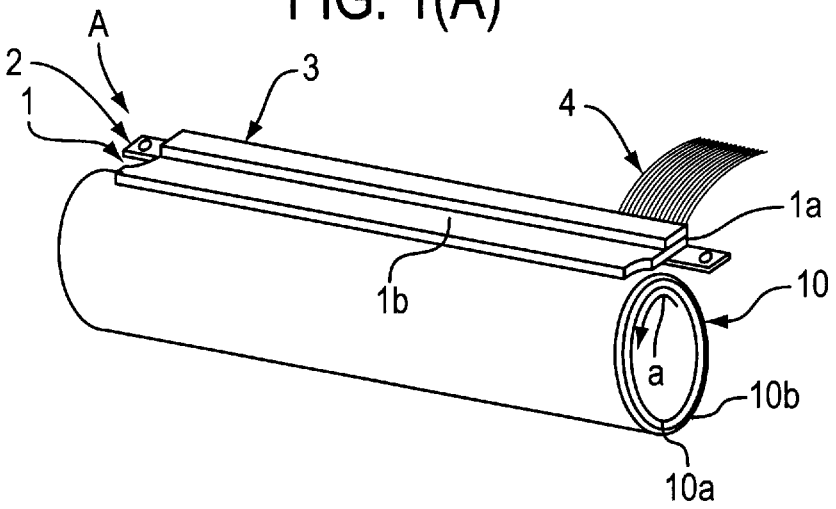
FIG. 1(A) is a perspective view of a first embodiment of the charging device of the present invention.
Figure 1B:
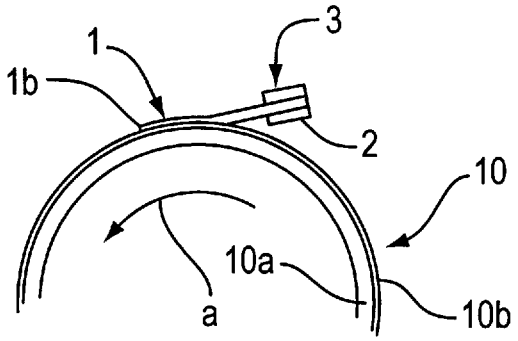
FIG. 1(B) is a side view of the charging device of the first embodiment.

Charging device A shown in FIGS. 1(A) and 1(B) is provided with a charge-receiving member 10 comprising an electrostatic latent image bearing member of a drum type, which is rotatably driven in the direction indicated by arrow a in FIGS. 1(A) and 1(B).

Charging device A is provided with a charging member 1 of a flexible sheet type, the charging member 1 being disposed along the direction of surface movement of the charge-receiving member 10, with end 1*a* on the upstream side in the direction of movement of the surface of the charge-receiving member being gripped between a support member 2 and a top pressing member 3 disposed thereabove and parallel to the direction of the rotational axis of the charge-receiving member 10 so as to be entirely supported in a cantilever support. At least end 1*b* on the downstream side is in contact with the surface of charge-receiving member 10 as a discharge part. The flexible electrode (described later) of charging member 1 is connected to a discharge-driving power unit (described later) via signal cable 4.

Charge-receiving member 10 comprises an electrically conductive drum (conductive substrate) 10*a*, the surface of which is provided with a coating of a dielectric layer 10*b*. Dielectric layer 10*b* can receives a sufficient surface charge via a discharge from charging member 1 without dielectric breakdown, and can maintain the surface charge (an electrostatic latent image) until the latent image is developed in a developing process via a developing device (not illustrated). Further, the dielectric layer can be easily discharged so as to be used repeatedly. The developing device accommodates a powder toner, which is used to develop the electrostatic latent image. The developed image is transported to a transfer region (not illustrated) via the rotation of the charge-receiving member 10, and is transferred onto a transfer member such as a paper sheet or the like. After the image transfer, the charge-receiving member 10 is discharged via a discharge means (not illustrated), such as a discharge brush or the like, to erase the electrostatic latent image. The image area arrives at the charging device A. Although a drum type member is used as charge-receiving member 10 in the forgoing discussion, the member may alternatively be configured as a belt or other shape. Furthermore, a photoconductive layer may be used instead of the aforesaid dielectric layer. When a photoconductive layer is used, the discharge may be accomplished by optical exposure of the entire surface, so as to be easily used repeatedly.

The previously mentioned dielectric layer 10*a* may be formed of polycarbonate, polyethylene terephthalate (PET), ethylene tetrafluoride resin, polymethyl methacrylate and the like.

Figure 2:
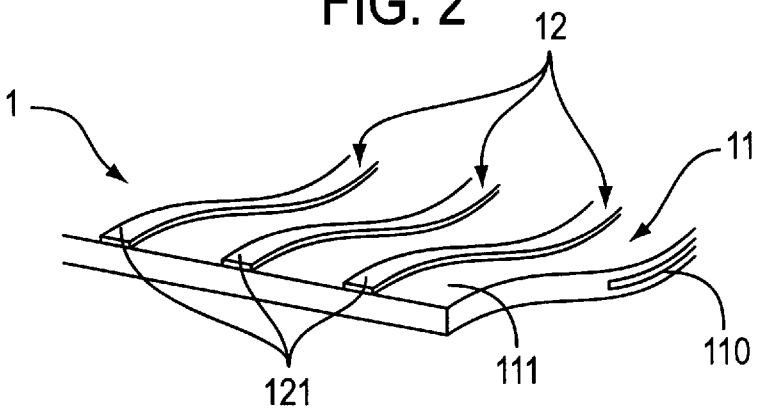
FIG. 2 is a perspective view of a part of the charging member of the charging device of FIG. 1(A).

FIG. 2 is a perspective view of the essential portion of charging member 1 of charging device A of FIG. 1(A). Charging member 1 is provided with a plurality of flexible electrodes 12 on one surface of a flexible sheet-like electrically insulated member 11 (hereinafter referred to as "flexible insulated member 11") as a flexible intermediate member. Flexible insulated member 11 has a conductive member 110 in its body, and forms a discharge gap between charge-receiving member 10 and tip of electrode 12 by contacting a surface of free end portion 111, which corresponds to the downstream side 1*b* and is opposite to a surface on which electrodes 12 are provided, which conforms to the surface of the charge-receiving member. The charging device charges the charge-receiving member by a discharge from the tips of electrodes 12.

In the charging member 1 of FIG. 2, each electrode 12 is a uniform thin band-type electrode having a width in the lengthwise direction of the member. A plurality of the electrodes 12 extend in the direction of movement of the surface of the charge-receiving member and are arranged in parallel at a predetermined spacing.

The common aspects of the charging member 1 shown in FIG. 2 and the charging members in other embodiments of the charging device of the present invention described later are mentioned below.

In other embodiments of the invention described later, like parts of the charging member are designated by like reference numbers, i.e., the charging member is referred to as "charging member 1", the flexible insulated member is referred to as "flexible insulated member 11", the electrodes are referred to as "electrodes 12", and the conductive member built in the flexible insulated member is referred to as "conductive member 110", as described in FIGS. 1(A), 1(B) and 2.

Commonalities include the desirability of having the thickness of the flexible insulated member 11, particularly the thickness of free edge 111 or the part in proximity therewith, in the range of about 5 to about 1,000 μm to produce excellent discharge. It is further desirable to have the thickness within the range of about 5 to about 200 μm to achieve adequate conformity to the undulations and surface irregularities of the surface of the charge-receiving member 10. When determining the desired thickness, the material type and Young's modules of the flexible insulated member should be considered. The distance between the charge-receiving member 10 and the tip 121 of the flexible electrode 12, which discharges when a discharge voltage is applied, is maintained at a constant distance by means of the thickness of the aforesaid part. Therefore, certain uniformity of aforesaid part is required so as not to influence on discharge.

The material of the flexible insulated member 11 may be a fluororesin (ethylene tetrafluoride and the like), urethane rubber, polyamide, polyester, polyethylene terephthalate (PET) and the like, but is not limited to the aforesaid.

The portion of the flexible insulated member 11, which comes into contact with the charge-receiving member 10, is desirably formed of material having excellent wear resistance, and is desirably formed of material having a small friction coefficient relative to charge-receiving member 10.

The flexible electrode 12 may be formed of materials such as metals including chrome, copper, gold, platinum, tungsten, aluminum, indium, titanium and the like, and conductive materials such as ITO, carbon and the like. Also, the flexible electrode 12 may be formed on the surface of the flexible insulated member 11 by methods such as photo-etched patterns and spattering, or other methods.

The flexible electrodes 12 formed on the flexible insulated member 11 may have at least the surface of their tip 121 covered by an inorganic thin film of metal oxide or diamond-like carbon thin film, to stabilize discharge over a long period by preventing soiling and corrosion of the electrode tip by ozone and nitrogen oxides byproducts produced during discharge. Because both the insulated member 11 and electrodes 12 are made of flexible materials, the cover should be formed in a range which can avoid cracking.

It is desirable that at least the tip 121 of the flexible electrode is covered by an overcoat material having a resistance higher than the resistance of the flexible electrodes so as to stabilize the discharge even under conditions of high humidity, so as to prevent leaks between two adjacent electrodes 12.

It is further desirable that at least the flexible electrode tip 121 is provided with semiconductive qualities within a range of about $10^2$ Ω•cm to about $10^8$ Ω•cm to prevent leaks between two adjacent electrodes abnormal dot discharges, and to obtain a stable discharge even under conditions of high humidity. To achieve the above mentioned conditions, at least the flexible electrode tip 121 may be covered with a material having a resistance higher than that of the flexible electrodes 12 (e.g., materials containing carbon), or formed by a semiconductive material. The length and thickness of the discharge parts should not differ from one electrode to another electrode, thereby avoiding discharge differences and excessive drive voltages due to the increase of the resistance value.

It is desirable for the width of the electrode 12 to be within the range of about several micrometers to about 100 μm. Furthermore, it is desirable for the distance between adjacent electrodes to be within the range of about 30 μm to about 100 μm, but resolution and leaks between adjacent electrodes should be also considered.

Charging of the surface of the charge-receiving member 10 via charging device A shown in FIG. 1(A) is described below with reference to FIGS. 3(A) and 3(B).

Figure 3A:
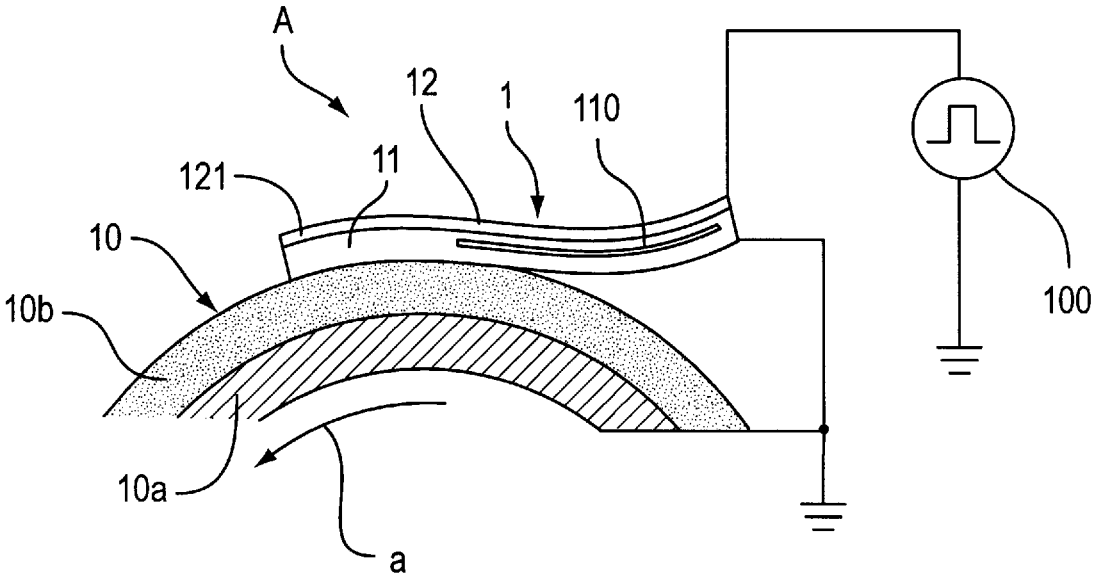
FIG. 3(A) is a side view of the print voltage application unit of a charging device of FIG. 1(A).

FIG. 3(A) is a side view showing charging member 1 of charging device A in contact with the charge-receiving member 10. As shown in FIG. 3(A), a part of flexible conductive member 110 overlaps the mutual contact surface of the charge-receiving member 10 and the flexible insulated member 11 of charging member 1 (i.e., the contact surface between charge-receiving member 10 and flexible insulated member 11) in a direction perpendicular to the contact surface. The conductive member 110 and conductive substrate 10*a* of charge-receiving member 10 are grounded. A printing voltage corresponding to a recording image is applied to flexible electrodes 12 from a printing power unit 100, which includes a drive power unit and an image signal forming unit described later. The applied voltage differs depending on the distance between the charge-receiving member 10 and the discharge tip of flexible electrode 12, that is, the thickness of flexible insulated member 11 in the vicinity of the discharging electrode tip, in accordance with Paschen's law. Generally, a greater thickness requires a higher applied voltage. The relationship between a minimum voltage applied to an electrode and the thickness of the flexible insulated member 11 in the vicinity of the discharge tip is expressed in the table below. This applied voltage can be reduced by using control electrodes (described later). When the voltage becomes somewhat high, the print line width increases, leaks occur between adjacent electrodes, and dielectric damage is caused to the charge-receiving member 10.

| Thickness of flexible insulated member near discharge tip | Minimum voltage applied to electrode |
|---|---|
| 5 μm | 400 V |
| 50 μm | 700 V |
| 100 μm | 1,000 V |
| 300 μm | 1,200 V |
| 1,000 μm | 1,700 V |

It is noted that the surface material of charge-receiving member 10 and material of the parts of the flexible insulated member in contact with charge-receiving member 10 (i.e., the material of dielectric layer 10*b*) may be selected so that the rank of the triboelectric series of the surface of charge-receiving member 10 differs from the rank of the triboelectric series of the part of flexible insulated member 11 in contact with charge-receiving member 10. Accordingly, the charge-receiving member 10 and flexible insulated member 11 are charged to mutually different polarities via triboelectric charging of the two, and they are attracted each other. The flexible insulated member 11 and charge-receiving member 10 are thus adhered to one another such that the charging member 1 conforms to the surface undulations of charge-receiving member 10 so as to normally maintain a constant distance between charge-receiving member 10 and discharge tips 121 of flexible electrodes 12.

Providing a power unit for electrostatically adhering the flexible insulated member 11 to charge-receiving member 10 or a pressure device to physically adhere the same are unnecessary when selecting materials so that the rank of the triboelectric series of the surface of charge-receiving member 10 differs from the rank of the triboelectric series of the part of flexible insulated member 11 in contact with charge-receiving member 10.

Figure 3B:
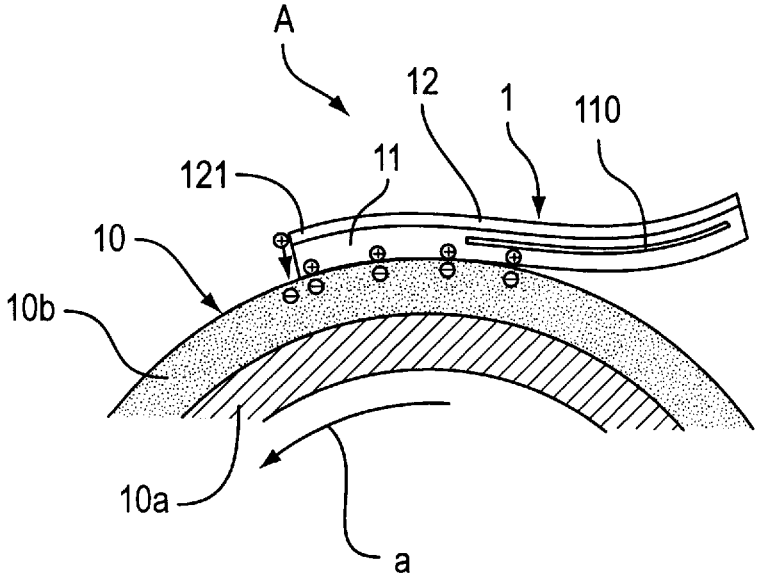
FIG. 3(B) shows the state of charging of the charge-receiving member.

In this example, the charge-receiving member 10 is triboelectrically charged to a negative polarity and the flexible insulated member 11 is triboelectrically charged to a positive polarity, as shown in FIG. 3(B), by using a polyethylene film as the flexible insulated member 11, and polyethylene terephthalate (PET) on dielectric layer 10*b* formed on the surface of charge-receiving member 10.

Various triboelectric series (friction charging sequence) are known, and one example is shown below. Considering the aforesaid friction-charging series, the other suitable materials for the flexible insulated member and material of the charge-receiving member may be selected from those shown below.

Positive Side polymethyl methacrylate
Nylon
Cellulose acetate
Epoxy resin
Silicone rubber
Polystyrene
Dacron
Polyethylene
Kanekalon (available from Kanekalon K.K.)
Cellophane
Vinyl chloride
Teflon
Milar (PET)
Ethylene trifluoride chloride resin
Unplasticized polyvinyl chloride resin Minus side As previously described, when, for example, PET is used for the flexible insulated member 11 and epoxy resin is used for the dielectric layer 10*b* of charge-receiving member 10, the charge-receiving member 10 is positively charged and the flexible insulated member 11 is negatively charged.

It is desirable that the charging potential of the charge-receiving member, produced by triboelectric charging between flexible insulated member 11 and charge-receiving member 10, is suppressed to a level that will not produce development by a developing device so as to avoid producing background fog when the triboelectrically charged charge-receiving member 10 is developed by the charging device (not illustrated) in an image forming apparatus. The relationship of ranks of triboelectric series of flexible insulated member 11 and charge-receiving member 10, mutual contact time between flexible insulated member 11 and charge-receiving member 10 (i.e., a longer contact time produces higher potential), and the relative moving speed of charge-receiving member 10 and the flexible insulated member 11 (i.e., a higher speed produces higher potential) may be suitably set so as not to produce overcharging of charge-receiving member 10 via friction.

Through experimentation, Applicants discovered that the flexible insulated member 11 and charge-receiving member 10 are smoothly charged by friction, and excellently adhere to each other in a case where the conductive member is provided in the vicinity of the portion in which a triboelectrical charge has occurred. Therefore, in this embodiment, a part of the conductive member 110 overlaps the contact surface between flexible insulated member 11 and charge-receiving member 10 (i.e., the mutual contact surface between flexible insulated member 11 and charge-receiving member 10) in a direction perpendicular to the surface. The conductive member 110 is grounded with the conductive substrate 10a of charge-receiving member 10.

FIG. 3(B) shows triboelectric charging and the state of discharge from electrode 12 for printing via the charging device of FIG. 3(A). During discharge, a positive voltage sufficient to produce discharge is applied to electrodes 12. As mentioned above, the flexible insulated member 11 is positively charged and the charge-receiving member 10 is negatively charged by friction. Since the difference in potential between flexible electrodes 12 and charge-receiving member 10 is greater than the difference in potential between electrodes 12 and flexible insulated member 11, a discharge properly occurs from flexible electrode 12 to charge-receiving member 10 and produces excellent printing. If the difference in potential between flexible electrode 12 and flexible insulated member 11 is less than the initial discharge voltage, even more improved printing is produced without a discharge therebetween.

Figure 4:
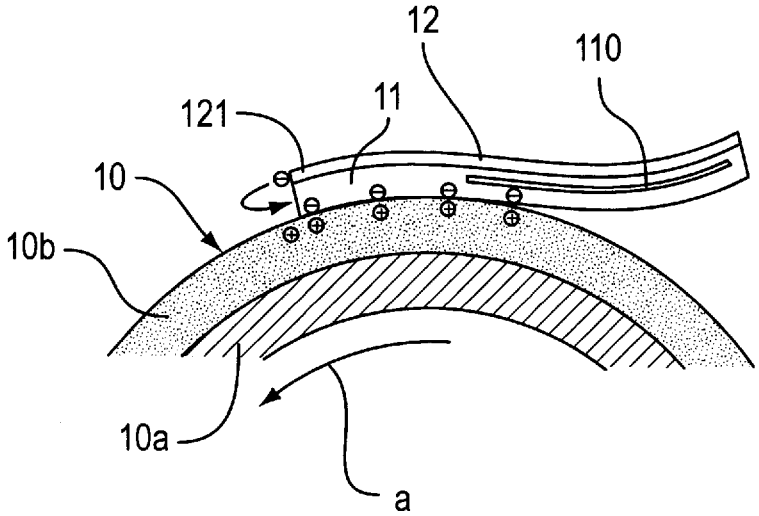
FIG. 4 is a reference drawing showing the opposite condition of the charging state via friction charging of the flexible insulated member and charge-receiving member shown in FIG. 3(A).

FIG. 4 shows a reference example of a charging device different than shown in FIG. 3. In this charging device, the flexible insulated member 11 is negatively charged and the charge-receiving member 10 is positively charged. The difference in potential between flexible electrode 12 and flexible insulated member 11 is greater than the potential difference between flexible electrode 12 and charge-receiving member 10, such that flexible electrode 12 readily discharges to flexible insulated member 11, and excellent printing is not obtained.

That is, if the polarity of the triboelectric series of the part of the flexible insulated member 11 that is in contact with the charge-receiving member 10 relative to the charge-receiving member 10 and the polarity of the voltage applied to the flexible electrode 12 relative to the charge-receiving member 10 during discharge are identical, then the difference in potential between the flexible electrode 12 and the charge-receiving member 10 becomes greater than the difference in potential between the flexible electrode 12 and flexible insulated member 11 so as to make excellent discharging possible.

In the aforesaid charging device A, the absolute value of the difference of the potential during discharge between the flexible electrode 12 and the potential in the vicinity of at least the discharge part 121 of the flexible electrode, which is among the parts of the flexible insulated member 11 acting as a flexible intermediate member in contact with the charge-receiving member 10, is set less than the absolute value of the difference between the potential of flexible electrode 12 and the potential of charge-receiving member 10 during discharge. Accordingly, abnormal discharge from the flexible electrode 12 to flexible insulated member 11 acting as the intermediate member is suppressed. On the other hand, stable discharge from flexible electrode 12 to charge-receiving member 10 is attained, such that the charge-receiving member 10 has stabilized discharge and poor discharge as well as poor printing is adequately suppressed.

Setting the absolute value of the difference of the potential during discharge between the flexible electrode 12 and the potential in the vicinity of at least the discharge part 121 of the flexible electrode 12, among parts of the flexible intermediate member in contact with the charge-receiving member 10, at a value less than the absolute value of the difference between the potential of flexible electrode 12 and the potential of charge-receiving member 10 during discharge is addressed in the series of charging devices of the present invention described hereinafter.

Figure 5:
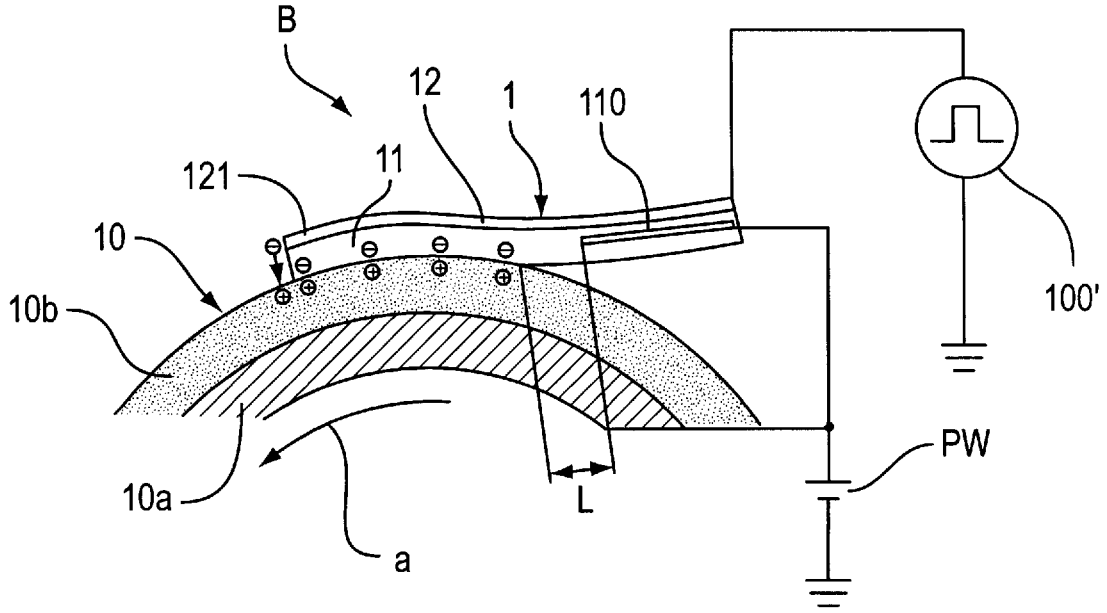
FIG. 5 is a brief side view of another embodiment of the charging device of the present invention.

FIG. 5 is a brief side view of another example of the charging device of the present invention. In charging device B, a flexible conductive member 110 is built into flexible insulated member 11. A part of the conductive member 110 is present at a position of L=1 mm distant from the edge of the contact surfaces of flexible insulated member 11 and charge-receiving member 10. A positive potential is applied from power unit PW thereto and to the conductive substrate 10*a* of charge-receiving member 10. Flexible electrodes 12 are grounded from an open state corresponding to a recording image, so as to produce a potential difference with the charge-receiving member 10 and to generate a discharge. In the drawing, reference number 100' refers to a printing voltage application unit including an image signal generating unit and a drive power unit. The difference in potential differs depending on the distance between the discharge tip 121 of flexible electrode 12 and charge-receiving member 10, i.e., the thickness of flexible insulated member 11 in the vicinity of the discharge tip is determined in accordance with Paschen's law. At this point, it is identical to the charging device shown in FIG. 3(B).

In this embodiment, flexible insulated member 11 is formed of PET, and the dielectric layer 10*b* of charge-receiving member 10 is formed of epoxy resin. Therefore, the flexible insulated member 11 is negatively charged, and the charge-receiving member 10 is positively charged by means of their relative movement and mutual contact.

The polarity of the of the triboelectric series of the parts of flexible insulated member 11 that comes into contact with the charge-receiving member 10 relative to the charge-receiving member 10 is negative, and the polarity of the voltage applied to the flexible electrodes 12 relative to charge-receiving member 10 is negative during charging. This point of identical polarities is similar to that described in the discussion of the charging device of FIG. 3(B). Therefore, the difference in potential between flexible electrode 12 and charge-receiving member 10 becomes greater than the difference in potential between flexible insulated member 11 and flexible electrode 12, making excellent discharge possible. The distance L between the conductive member 110 and the edge of the contact surface between flexible insulated member 11 and charge-receiving member 10 affects triboelectrical charging. When this distance L is less than about 5 mm, the adhesion force between flexible insulated member 11 and charge-receiving member 10 does not pose a practical problem. When this distance L is less than about 2 mm, or less than about 1 mm, the adhesion force increases. In this embodiment, a distance L of about 1 mm is used.

In other aspects, the charging device is identical to the charging device of FIG. 3(A).

Figure 6:
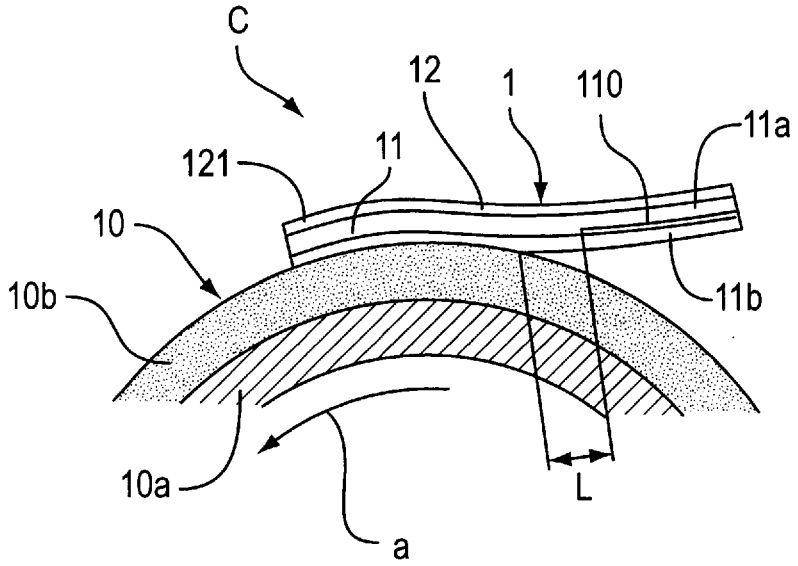
FIG. 6 is a brief side view of another embodiment of the charging device of the present invention.

FIG. 6 is a brief side view showing another example of the charging device of the present invention. In charging device C, flexible insulated member 11 comprises a top layer 11*a* and a bottom layer 11*b* laminated thereon. Flexible electrodes 12 are provided on top layer 11*a*, and bottom layer 11*b* comes into contact with charge-receiving member 10. A flexible conductive member 110 is provided between top layer 11*a* and bottom layer 11*b*. Conductive member 110 is disposed at a position separated a distance L (i.e., distance L is about 5 mm or less) from the edge of the contact surface between flexible insulated member 11 (i.e., bottom layer 11*b*) and charge-receiving member 10. Thus, conductive member 110 is easily provided. Further, for example, the material of bottom layer 11*b* of flexible insulated member 11 may be selected so as to have excellent friction-charging characteristics, wear resistance, and frictional force relative to charge-receiving member 10. Also, the material of top layer 11*a* may be selected so minimize leaks between flexible electrodes 12.

In other respects this charging device is identical to the charging device of FIG. 3(A).

Figure 7:
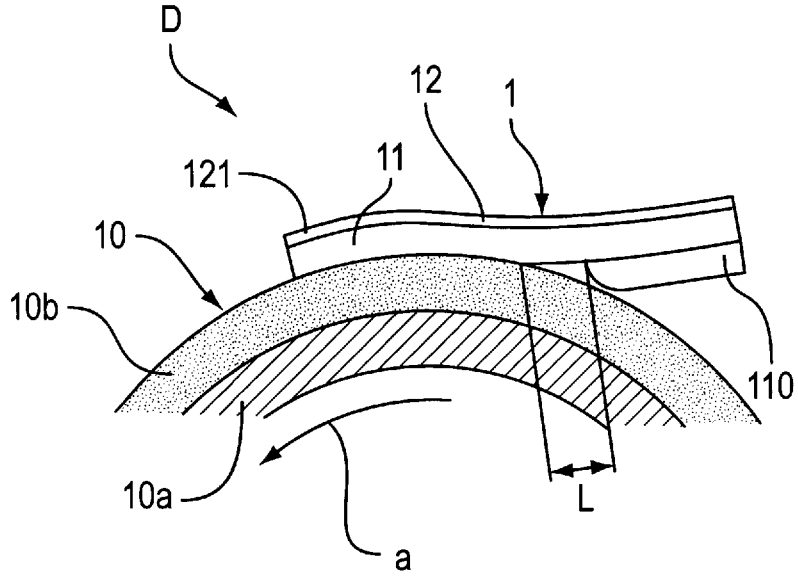
FIG. 7 is a brief side view of another embodiment of the charging device of the present invention.

FIG. 7 shows another example of the charging device of the present invention. In charging device D, a conductive member 110 is fixedly attached to the bottom surface of flexible insulated member 11 and functions as the support member of the charging member 1. The conductive member is disposed at a position separated by a distance L (i.e., distance L is less than about 5 mm) from the edge of the mutual contact surface of flexible insulated member 11 and charge-receiving member 10. Thus, the entire construction of the charging device is simplified, and the number of parts is reduced.

In other respects this charging device is similar to the charging device of FIG. 3(A).

Another example of the charging member used in the present invention is described below. The charging member described below is provided with a conductive member 110 to provide smooth and reliable triboelectric charging, and charging member adhesion.

Figure 8:
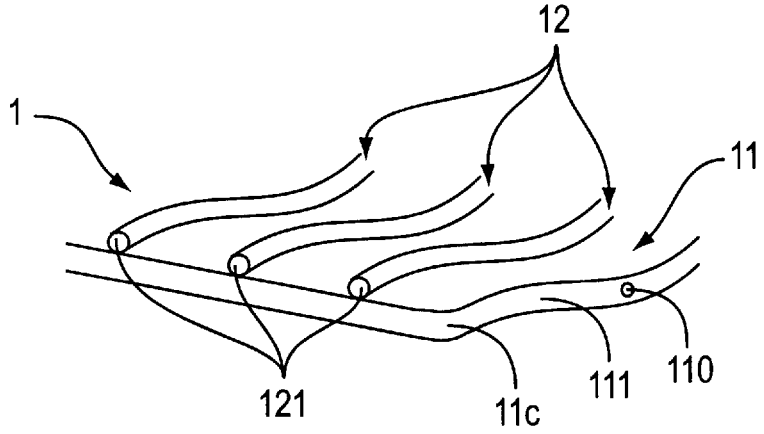
FIG. 8 is a perspective view showing part of another embodiment of the charging member of the present invention.

The charging member 1 of FIG. 8 comprises flexible electrodes 12 formed of tungsten wire about 10 $\mu$m to about 100 $\mu$m in diameter fixedly attached via insulated adhesive, or the like, to flexible insulated member 11. The surface of flexible insulated member 11 on the side opposite the side provided with electrodes 12 contacts charge-receiving member 10. A thin, wire-like conductive member 110 is embedded in flexible insulated member 11 in a direction perpendicular to the electrodes 12. The biangular part 11*c* of the free end of flexible insulated member 11 has an arced shape to prevent warping and floating of the charging member.

Figure 9A:
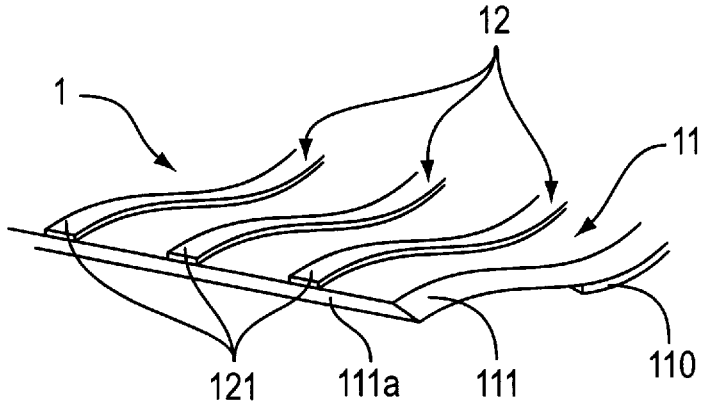
FIG. 9(A) is a perspective view of another embodiment of the charging member of the present invention.
Figure 9B:
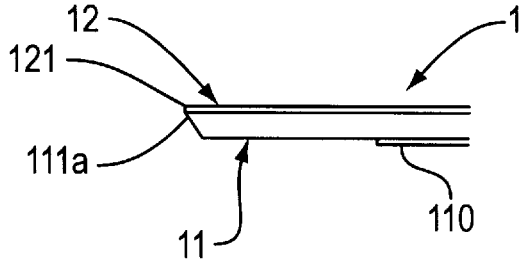
FIG. 9(B) is a side view of part of the charging member shown in FIG. 9(A).

The charging member 1 of FIGS. 9(A) and 9(B) is a modification of the charging member of FIG. 2. The inclined portion 111*a* of flexible insulated member edge 111, provided with the discharging electrode tip 121 of flexible electrode 12, is cut at an inclination, so as to extend canopy-like in the direction of surface movement of the charging member to easily allow discharge from the electrode tip (discharge tip) 121. Conductive member 110 is provided on the surface of flexible insulated member 11 on the opposite side relative to electrodes 12.

Figure 10:
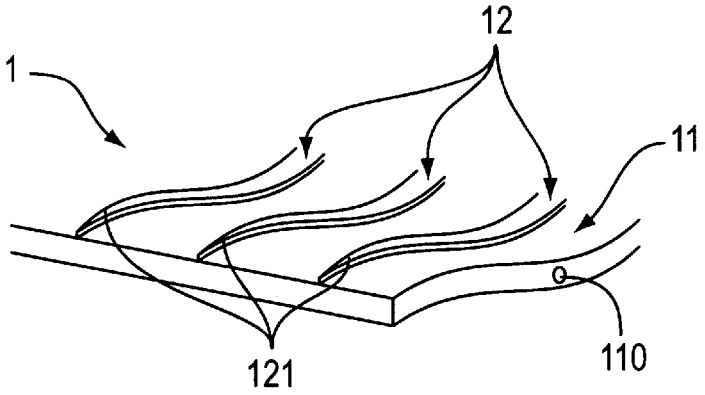
FIG. 10 is a perspective view of another embodiment of the charging device of the present invention.

The charging device of FIG. 10 is a modification of the charging member of FIG. 2. The tip 121 of flexible electrode 12 is narrower than the other part of the electrode to allow easy discharge at the tip 121 and reduce the drive voltage, as well as reduce the printing diameter. The conductive member 110 is a wire similar to the charging member of FIG. 8.

Figure 11:
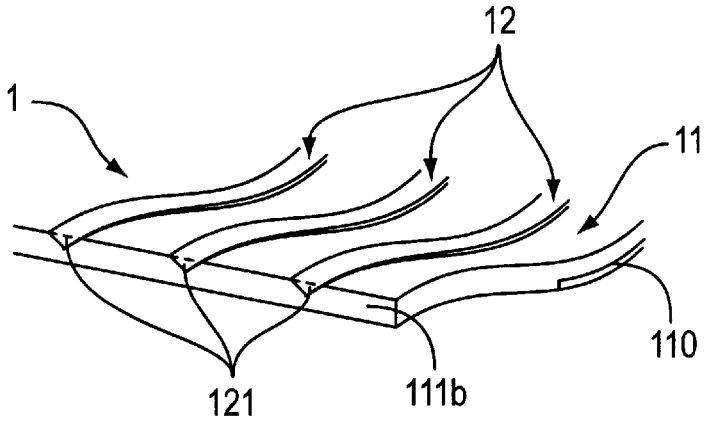
FIG. 11 is a perspective view of another embodiment of the charging device of the present invention.

Charging member 1 of FIG. 11 is a modification of the charging member of FIG. 2. The tip 121 of electrode 12 wraps around to the free endface 111*b* of flexible insulated member 11 to enlarge the discharge area and allow easy discharge. The conductive member 110 is provided on the side opposite electrode 12 and aligned with the surface position of the surface of flexible insulated member 11.

Figure 12:
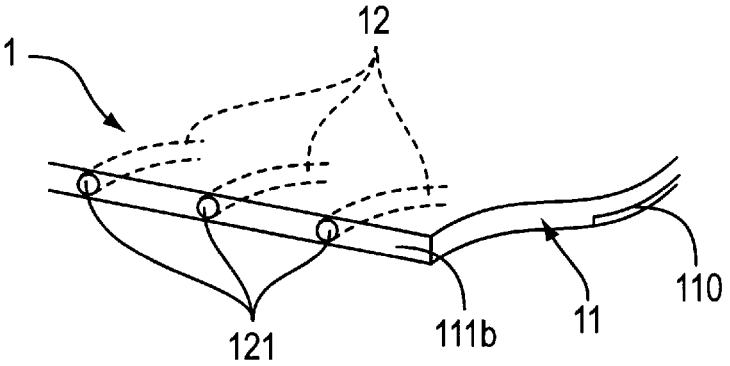
FIG. 12 is a perspective view of another embodiment of the charging device of the present invention.

The charging member 1 of FIG. 12 has flexible electrodes 12 provided within flexible insulated member 11, with the endface of the discharge tip 121 exposed at the insulated member surface 111*b*. This charging member may be formed by a method which forms flexible insulated member 11 around flexible electrodes 12, or by sandwiching flexible electrodes 12 between two flexible insulated members. Such a construction is particularly effective in preventing leaks between electrodes outside the discharge area under conditions of high humidity. Such a construction may be used in other charging members. In the charging member of FIG. 2, for example, an electrically insulated member may be provided on the side of flexible insulated member 11 provided with flexible electrodes 12 by liquid application, vacuum deposition, gluing or the like to obtain a similar effect. Conductive member 110 may similarly be provided on the charging member of FIG. 11.

Figure 13:
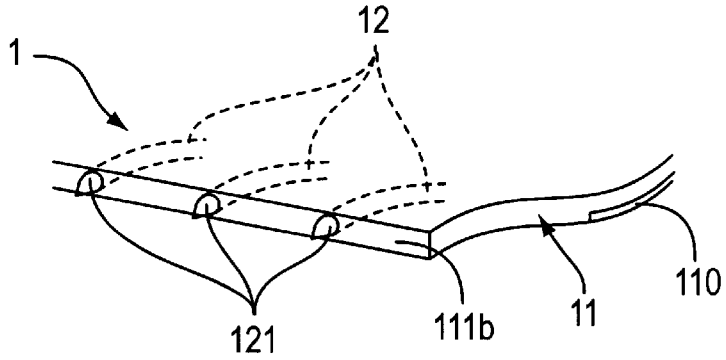
FIG. 13 is a perspective view of another embodiment of the charging device of the present invention.

The charging member 1 of FIG. 13 has flexible electrodes 12 provided within flexible insulated member 11, as shown in FIG. 12, but the discharge tip 121 of electrode 12 extends from the insulated member endface 111*b*. This construction makes leaks unlikely under conditions of high humidity because creeping distance of the discharge area and charge-receiving member is lengthened, and discharge is easy because the open space is widened between the discharge tip 121 and charge-receiving member. Conductive member 110 may be provided on the charging member in the same manner of the charging member of FIG. 11.

Figure 14A:
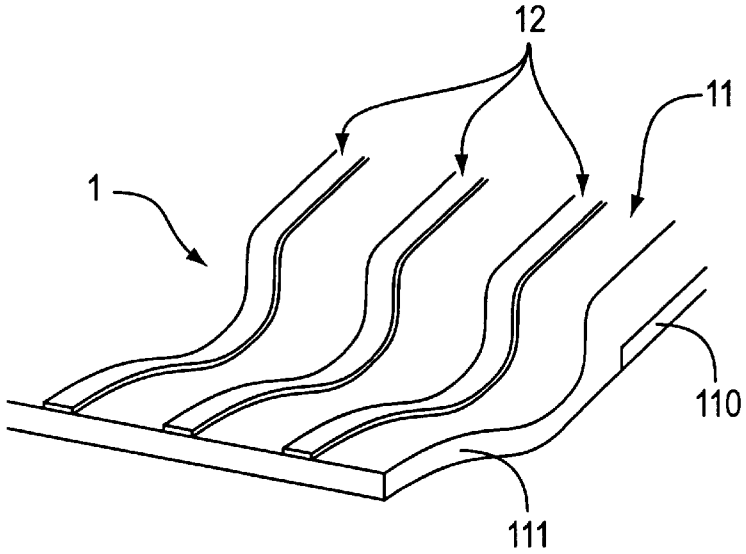
FIG. 14(A) is a perspective view of another embodiment of the charging member of the present invention.
Figure 14B:
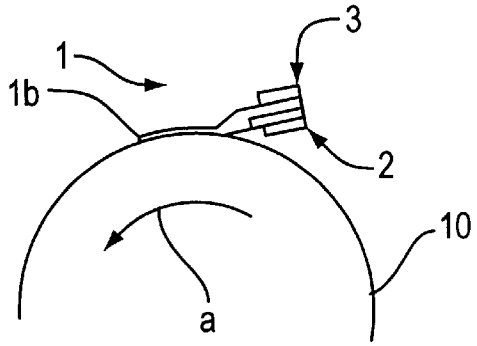
FIG. 14(B) is a side view of the same charging member shown in FIG. 14(A).

In the charging member 1 of FIG. 14(A), the thickness of the free tip 111 of flexible insulated member 11 is about 5 to about 1,000 $\mu$m, and the part near the support area of flexible insulated member 11 is thicker at about several hundreds micrometers to about several millimeters. As shown in FIG. 14(B), the vicinity of the border between the thick part and the thin part of flexible insulated member 11 is the area of initial contact between flexible insulated member 11 and charge-receiving member 10. Although the friction coefficient of the contact surface between charge-receiving member 10 and flexible insulated member 11 is a factor, if the thickness of flexible insulated member 11 is entirely uniform at about 5 to about 1,000 $\mu$m, as in the case of the charging member of FIG. 2, for example, the flexible insulated member 11 readily oscillates in the direction of surface movement of the charge-receiving member. This is due to the combination of the force moving the flexible insulated member 11 in the direction of movement of charge-receiving member 10 via the frictional force accompanying the movement of the surface of charge-receiving member 10, and the stress force of the fixedly mounted flexible insulated member 11. The charging member 1 of FIG. 14(A), however, is supported at the thick part of flexible insulated member 11, thereby increasing durability near the support part of the member 11, and stabilizing the initial contact area between flexible insulated member 11 and charge-receiving member 10. Therefore, oscillation of flexible insulated member 11 is reduced in the direction of the surface movement of the charge-receiving member so as to provide even more suppression of irregular printing. Conductive member 110 may be similarly provided on the charging member as provided in FIG. 11.

Figure 15:
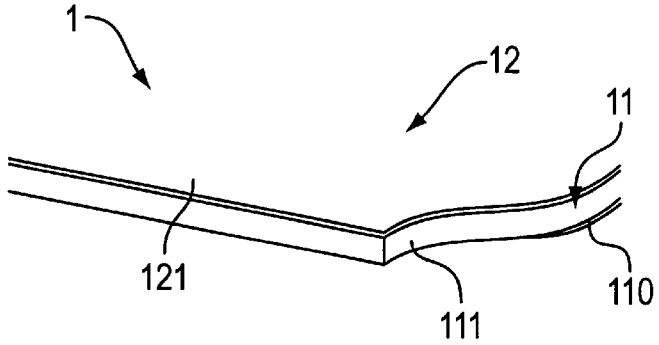
FIG. 15 is a perspective view of another embodiment of the charging device of the present invention.

The charging member 1 of FIG. 15 is provided with a flexible electrode 12 over the entirety of the surface of flexible insulated member 11, so as to uniformly charge the entire surface of charge-receiving member 10. A conductive member 110 is also provided in this example. The present invention is applicable for use in charging devices using a charging member for uniform charging as this example. Furthermore, the present invention is applicable to other types of charging devices. Other embodiments of the present invention are shown in FIGS. 16(A) and 16(B), 17(A) and 17(B) and 18.

Figure 16A:
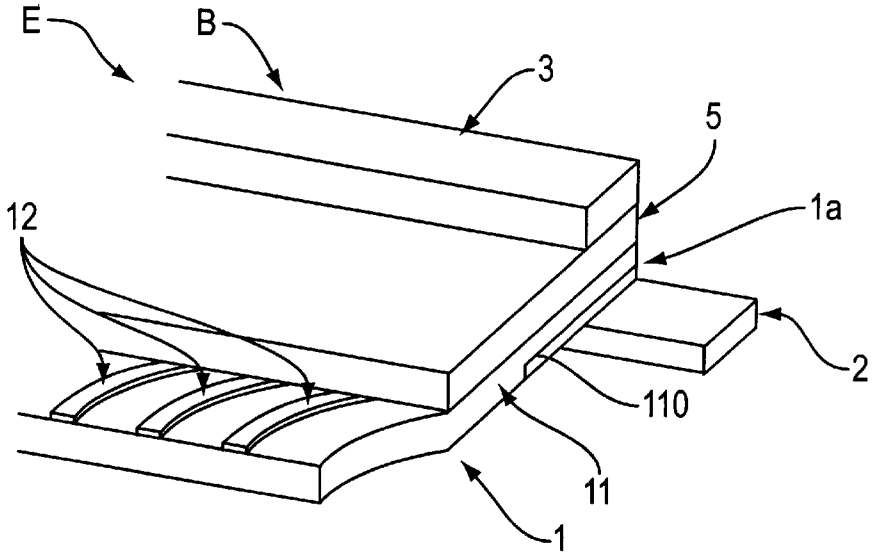
FIG. 16(A) is a perspective view of another embodiment of the charging member of the present invention.
Figure 16B:
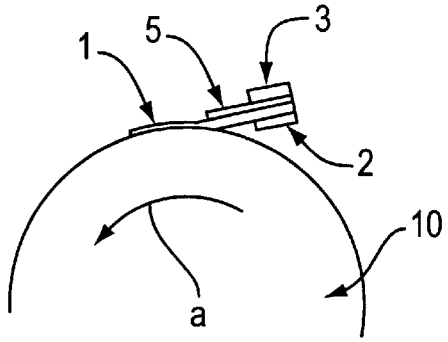
FIG. 16(B) is a side view of the same charging member shown in FIG. 16(A).

Charging device E shown in FIGS. 16(A) and 16(B) is provided with a charging member 1 which abuts an elastic member 5 at the part supported by support member 2 and pressing member 3 and the parts in proximity thereto. Elastic member 5 and charging member 1 are gripped by support member 2 and pressing member 3. In other respects, this device is similar to the charging device shown in FIGS. 1(A) and 1(B). Conductive member 110, however, is laminated on the bottom surface of flexible insulated member 11. Charging member 1 is pressed by elastic member 5 to set the part of initial contact between flexible insulated member 11 and charge-receiving member 10, as shown in FIG. 16(B). Specifically, the vicinity on the downstream side of elastic member 5 pressing the charging member 1 becomes the part that makes initial contact between flexible insulated member 11 and charge-receiving member 10. In charging device E, there is scant oscillation of flexible insulated member 11 in the direction of surface movement of the charge-receiving member via the frictional force accompanying the surface movement of charge-receiving member 10.

Figure 17A:
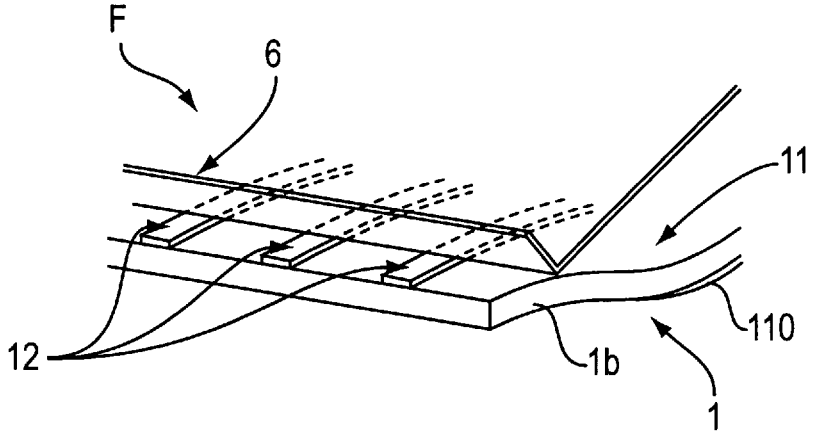
FIG. 17(A) is a perspective view of another embodiment of the charging member of the present invention.
Figure 17B:
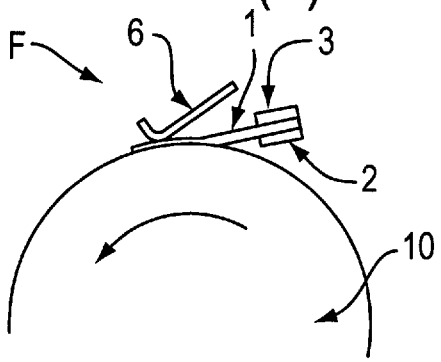
FIG. 17(B) is a side view of the same charging member shown in FIG. 17(A).

In charging device F shown in FIGS. 17(A) and 17(B), the charging member 1 is pressed against the charge-receiving member 10 by the pressing member 6 in charging device A of FIG. 1(A). Conductive member 110, however, is laminated on the bottom surface of flexible insulated member 11. Pressing member 6 presses near the edge 1*b* of charging member 1 so as to maintain a constant distance between flexible electrodes 12 and charge-receiving member 10. The charging device F not only provides excellent conformity of charging member 1 relative to eccentricity and large undulations of charge-receiving member 10 by simple pressure applied by pressing member 6, but when adequate conformity is not achieved, relative to the small surface irregularities of charge-receiving member 10, conformity to the various irregularities is improved in conjunction with the pressing member 6 by the attraction of charging member 1 to charge-receiving member 10 via triboelectric charging.

Figure 18:
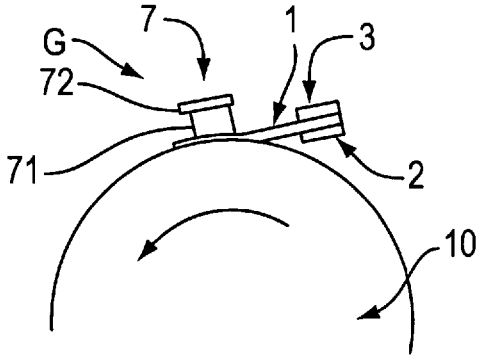
FIG. 18 is a side view of another embodiment of the charging device of the present invention.

The charging device G of FIG. 18 is provided with a charging member 1 pressed against charge-receiving member 10 via a pressing member 7 in the charging device A of FIG. 1(A). The pressing member 7 comprises a support member 72 and pressing body 71, and applies pressure near the edge of charging member 1 so as to maintain a uniform distance between flexible electrodes 12 and charge-receiving member 10. In charging device G, attraction produced by triboelectric charging is also used to achieve excellent conformity of the charging member 1 to the eccentricity and undulating of the charge-receiving member 10, as well as the small surface irregularities of the charge-receiving member 10. The pressing body 71 may be formed of urethane foam, silicone rubber foam or the like capable of sufficient transmission and having adequate conformity relative to the pressure.

Figure 19:
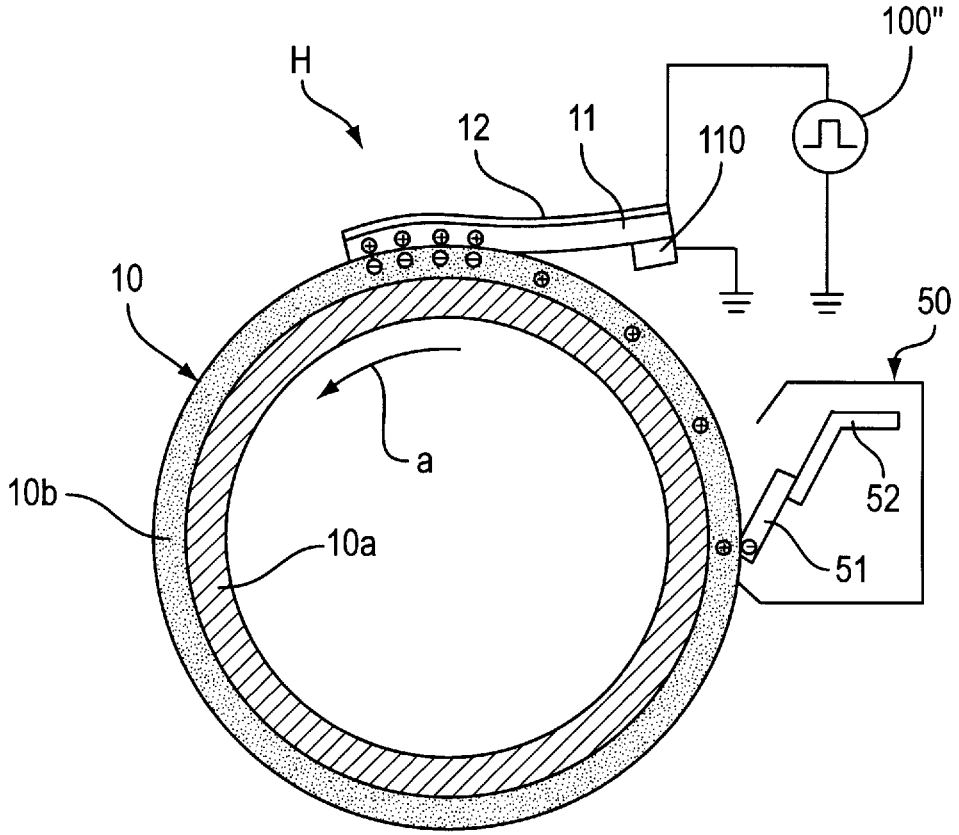
FIG. 19 is a brief side view showing part of an image forming apparatus using the charging device of the present invention.

FIG. 19 is a side view of part of an image forming apparatus depicting the charging device H, the charge-receiving member 10, and the cleaning device 50. As shown in FIG. 19, the cleaning device 50 is provided on the upstream side of the charging device H. The cleaning device 50 is formed by adhering a cleaning member (i.e., a cleaning blade) 51 to a support member 52. The cleaning member 51 is arranged so as to come into contact with charge-receiving member 10 so as to remove residual toner therefrom. The material of dielectric member 10*b* of charge-receiving member 10, the material of flexible insulated member 11 of the charging member, and the material of cleaning member 51 are all selected such that when the charge-receiving member 10 is driven in rotation in the direction of the arrow depicted in the drawing, and triboelectric charging is accomplished with the positive polarity of the cleaning member 51 to the charge-receiving member 10 and the negative polarity of the charge cleaning member. As a result, the flexible insulated member 11 of charging member 1 and charge-receiving member 10 are triboelectrically charged, such that flexible the insulated member 11 is charged to a positive polarity and charge-receiving member 10 is charged to a negative polarity. Therefore, the charge-receiving member 10, which is triboelectrically charged to a positive polarity by cleaning member 51, does not generate a discharge because it has the same polarity as that of the area in contact with flexible insulated member 11. If the flexible insulated member 11 were to be charged to a negative polarity via contact with cleaning member 51, a discharge would occur between the flexible insulated member 11 and charge-receiving member 10 due to the difference in potential, thereby causing irregular potential and discharge noise on charge-receiving member 10. In FIG. 19, reference number 100" refers to a printing voltage application region.

Figure 20:
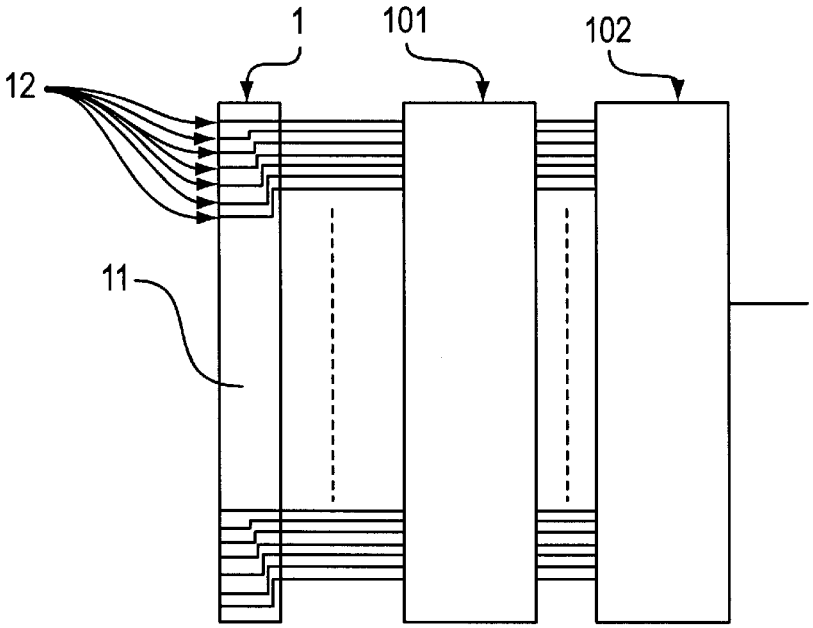
FIG. 20 shows an example of an electrical circuit used in the charging device of the present invention.

FIG. 20 shows an example of an electrical circuit used in a charging device of the present invention, including the previously described charging devices (excluding the charging devices using the charging member shown in FIG. 15).

According to this electrical circuit, print signals corresponding to the image to be printed are formed in image processing unit 102 and are output to a drive power unit 101. Drive power unit 101 boosts the print signals to high voltage signals, and these high voltage print signals are applied to the various flexible electrodes 12 of charging member 1.

Figure 21:
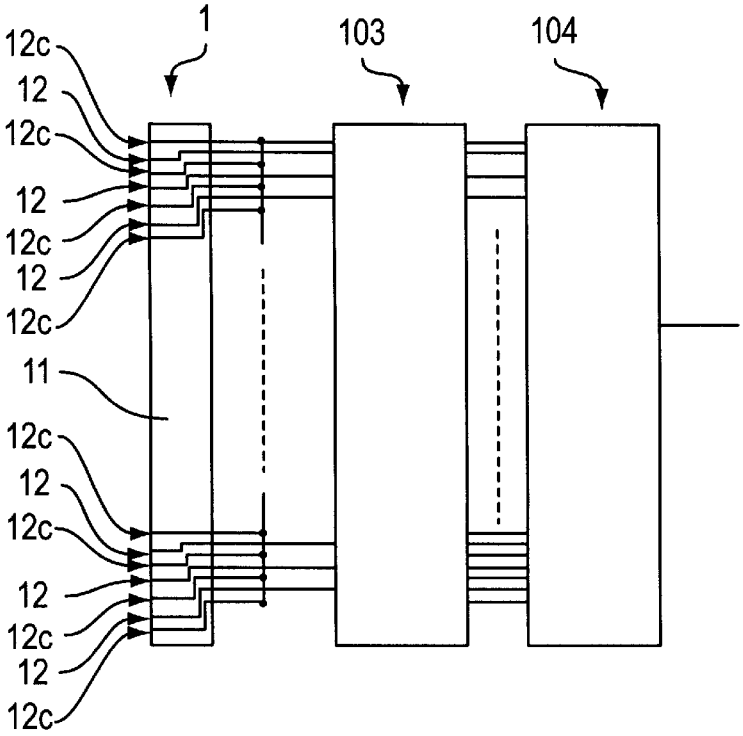
FIG. 21 shows another example of an electrical circuit usable in the charging device of the present invention.

FIG. 21 shows another example of an electrical circuit used in a charging device of the present invention (excluding the charging devices using the charging member shown in FIG. 15). In this example, charging member 1 is provided with flexible control electrodes 12*c* between adjacent flexible electrodes 12 and the electrodes 12 on the bilateral exterior sides. This circuit outputs print signals corresponding to an image to be printed which are formed in image processing unit 104 to drive power unit 103. The drive power unit 103 boosts the print signals to high voltage signals, and the high voltage print signals are applied to the various electrodes 12 of charging device 1. A voltage is also applied to each control electrode 12*c*. The voltage applied to the control electrodes 12*c* may be, for example, a voltage which is intermediate to the voltage applied to the flexible electrodes 12 (discharge voltage) and a ground voltage, so as to reduce the difference in potential between the flexible electrodes 12 and the control electrodes 12*c*, thereby preventing leaks between analogous electrodes. Furthermore, the printing diameter is stabilized by reducing the effects of interaction of the potentials of adjacent flexible electrodes 12. The printing diameter can be reduced by means of the voltage applied to the control electrodes 12*c*. That is, when looking at a single discharge electrode 12, the printing diameter can be reduced by controlling the spread of the discharge from the discharge electrode 12 via the application of a voltage to the control electrodes 12*c* on the bilateral sides thereof (i.e., narrowing the discharge via the voltage applied to control electrodes 12*c*).

Figure 22:
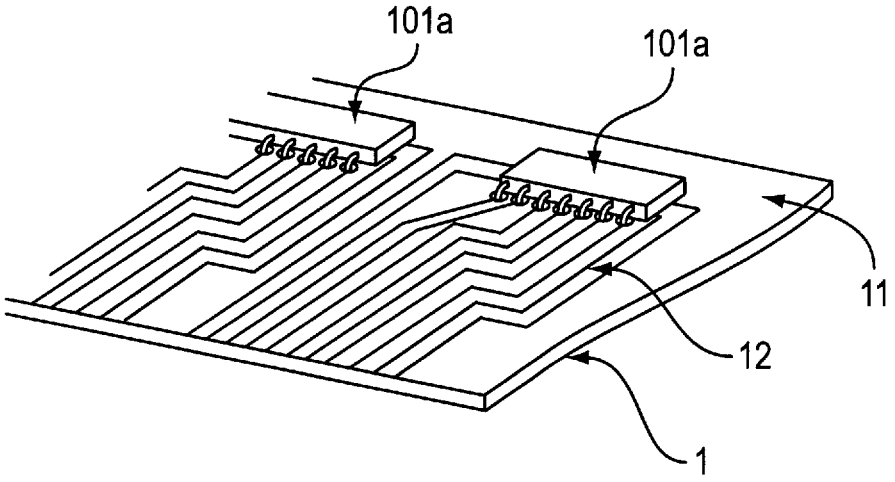
FIG. 22 shows another example of an electrical circuit usable in the charging device of the present invention.

FIG. 22 shows another example of an electrical circuit used in a charging device of the present invention (excluding the charging devices using the charging member shown in FIG. 15). In this example, charging member 1 is provided with flexible electrodes (discharge electrodes) 12 to which is applied high voltage print signals from integrated circuit (IC) type drive power units 101*a* directly connected to a flexible insulated member 1. This construction is compact, and reduces the number of signal cables between a charging member and a unit including an image forming apparatus.

Figure 23:
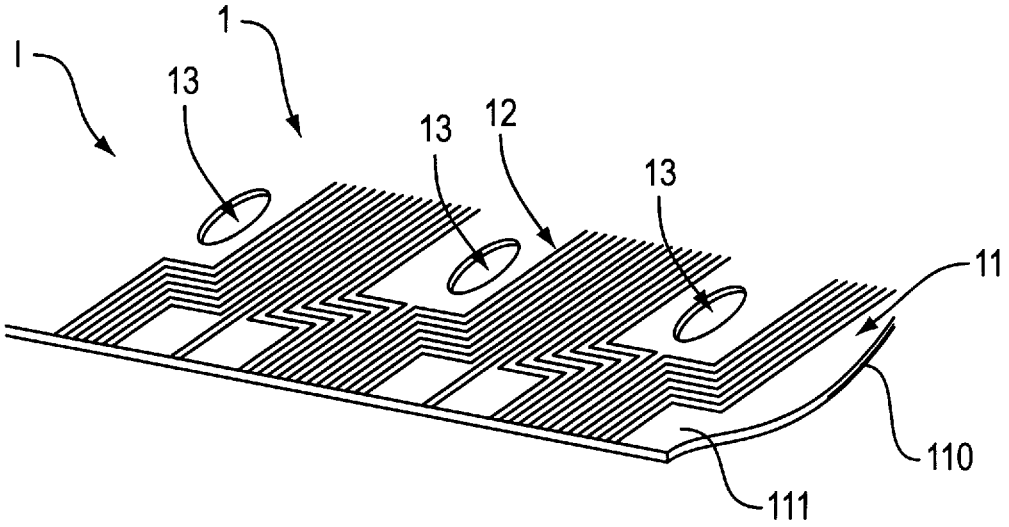
FIG. 23 is a perspective view showing part of another embodiment of the charging member of the present invention.

Another example of the charging device of the present invention is described hereinafter with reference to FIG. 23. FIG. 23 is a perspective view showing the essential part of the charging device. Although this charging device I is not shown in its entirety in the drawing, it has the basic construction similar to that of charging device A of FIG. 1. The present charging device uses the charging member 1 of FIG. 23 in the basic construction of charging device A of FIG. 1 and the electrical circuit of FIG. 20 is also used. Charging member 1 of FIG. 23 is provided with a plurality of flexible electrodes 12 on one side of a flexible insulated member 11, and a conductive member 110 on the opposite side to provide smooth, reliable triboelectric charging and adhesion of the charging member. Ventilation holes 13 are formed in flexible insulated member 11 in an area that does not have electrodes 12 on the downstream side from the support portion (i.e., at the upstream edge in the direction of movement of the surface of the charge-receiving member) of charging member 1 formed by support member 2 and pressing member 3 (refer to FIG. 1). The position of these ventilation holes 13 are such that a certain part of the ventilation hole 13 does not touch the charge-receiving member 10 when the charge-receiving member 10 is rotating.

According to charging device I, the charging member 1, which has flexibility, comes into contact with charge-receiving member 10 at the downstream part 111 of flexible insulated member 11. A discharge occurs from the flexible electrode 12 to the surface of charge-receiving member 10 in the aforesaid contact state, such that the surface of charge-receiving member 10 is charged in a predetermined manner.

Airflow generated by the movement of the surface of charge-receiving member 10 escapes through the ventilation holes 13 provided in charging member 1, to suppress lifting of the charging member 1 by the airflow. Charging member 1 is adhered to the surface of charge-receiving member 10 by means of the triboelectric charging between flexible insulated member 11 and charge-receiving member 10, such that charging member 1 sits in contact with charge-receiving member 10 so as to maintain uniform discharge distance between charge-receiving member 10 and each electrode 12 by means of the action of the triboelectric charging and airflow escape.

Ventilation holes 13 may be provided in other charging members used in the charging device of the present invention, and may be provided in the charging member shown in FIG. 15.

Figure 24A:
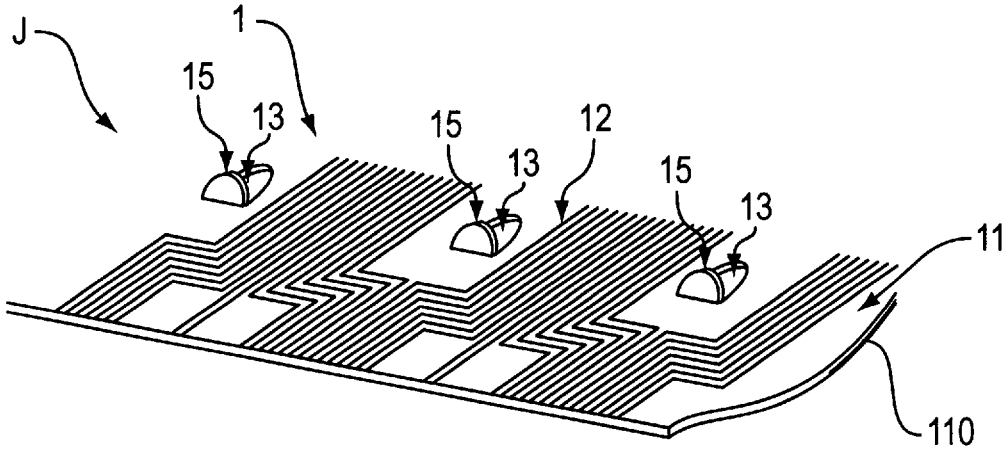
FIG. 24(A) is a perspective view of another embodiment of the charging member of the present invention.
Figure 24B:
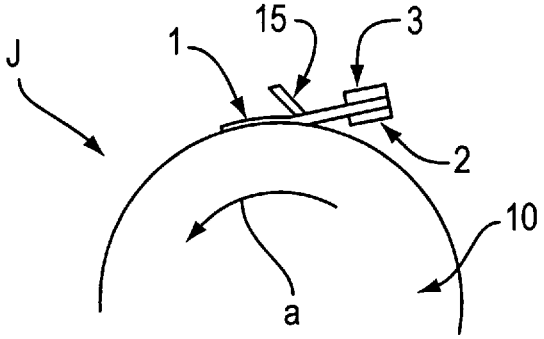
FIG. 24(B) is a side view of the same charging member.

Another example of the charging device of the present invention is described below with reference to FIGS. 24(A) and 24(B). Charging device J shown in FIGS. 24(A) and 24(B) provides a pressing fin 15 on the downstream side of ventilation hole 13 of charging member 1 in the charging device I described in FIG. 23. Fin 15 is provided to receive the force of the airflow passing through the ventilation hole 13.

According to charging device J, the airflow generated by the rotation of charge-receiving member 10 escapes through the ventilation holes 13 provided in charging member 1 to suppress the lifting of the charging member 1. Fins 15 receives the force of the airflow passing through the ventilation holes 13, so as to press charging member 1 toward charge-receiving member 10. Thus, lifting of charging member 1 is suppressed all the more. Further, flexible insulated member 11 is adhered to charge-receiving member 10 via triboelectric charging between flexible insulated member 11 and charge-receiving member 10. Thus, a constant discharge distance is maintained between each electrode 12 of charging member 1 and charge-receiving member 10 regardless of, for example, the undulations and surface irregularities of charge-receiving member 10 or the airflow generated by the rotation of charge-receiving member 10. The electrical circuit of FIG. 20 may be used in the charging device of FIG. 24.

Each fin 15 requires a certain degree of hardness in view of its function. There is a possibility that the action of a ventilation hole 13 and a fin 15 may cause the flexible insulated member 11 to bend, and there is concern that air pressure may cause the flexible insulated member 11 to bend due to its flexibility, causing a loss of effectiveness in having flexible insulated member 11 adequately press against charge-receiving member 10. Accordingly, flexible insulated member 11 may be made thicker in the vicinity of a ventilation holes 13, or a separate member may be glued in the vicinity of the ventilation holes 13. Of course, fin 15 may be formed by another member mounted on flexible insulated member 11.

The combination of ventilation holes 13 and pressing fins 15 may be provided on other charging members used in the charging device of the present invention, and may be provided on the charging member shown in FIG. 15.

Figure 25:
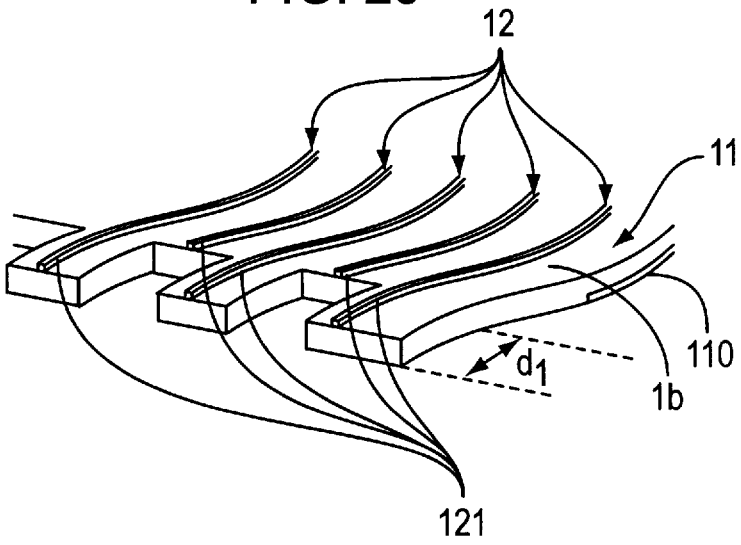
FIG. 25 is a perspective view showing part of another embodiment of the charging member of the present invention.

FIG. 25 shows a charging member in another example of the charging device of the present invention.

This charging member 1 is provided with flexible wire electrodes 12 on flexible insulated member 11, and the downstream side edge 1*b* in the direction of surface movement of the charge-receiving member forms a sprocket-like configuration such that discharge tips 121 of adjacent electrodes 12 are staggered a distance in the direction of movement of the surface of charge-receiving member so as to be longer than tips 121 which are not in the configuration. Thus, under conditions of high humidity for example, leaks between adjacent electrodes are suppressed and print errors caused by the leaks do not occur even when the electrode density is increased in the direction intersecting the direction of movement of the surface of charge-receiving member, and high precision images are obtained.

In this charging member, print signals applied to downstream side electrodes must be delayed by time t1 (in seconds), when the time t1 is referred as print delay time between upstream electrode and downstream electrode. Time t1 is defined by the speed of travel of the surface of charge-receiving member 10 and distance is defined as the direction of the surface movement of the charge-receiving member between tip of upstream electrode and tip of downstream electrode. In this case, the peak voltage applied to charging member 1 can be reduced by setting the print pulse cycle time to a value that deviates from an integer multiple and 1/(integer multiple) of time t1. Peak voltage can also be desirably reduced by shifting the print signal by one half the print pulse cycle time.

This charging member 1 is also provided with a conductive member 110 to provide smooth, reliable triboelectric charging and adhesion of the charging member.

Figure 26:
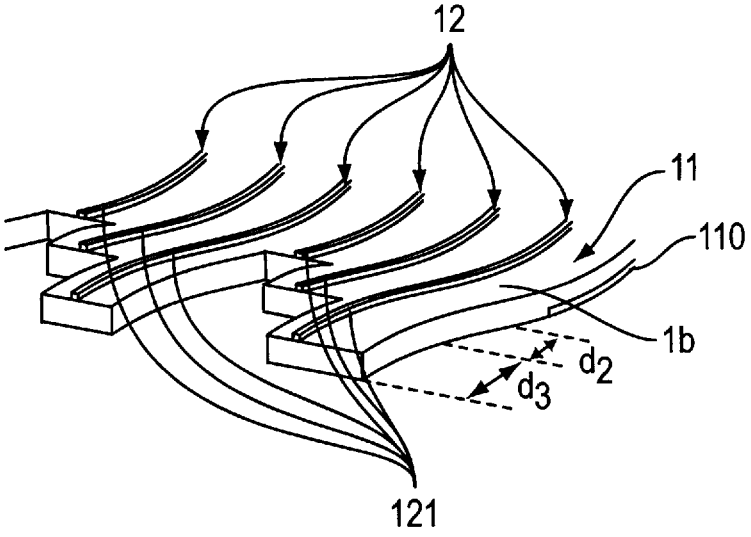
FIG. 26 is a perspective view showing part of another embodiment of the charging member of the present invention.

FIG. 26 shows another example of the charging member of the charging device of the present invention.

This charging member 1 is provided with flexible wire electrodes 12 on flexible insulated member 11, and downstream edge 1*b* forms a 3-stage sprocket-like configuration in the direction of surface movement of the charge-receiving member. In this instance, the distance between tips 121 of analogous adjacent electrodes 12 is longer compared to a non-sprocket configuration. Therefore, even under conditions of high humidity for example, leaks between adjacent electrodes are suppressed and print errors caused by the leaks do not occur even when the electrode density is increased in the direction intersecting the direction of movement of the surface of charge-receiving member, and high precision images are obtained.

As can be understood from the above example, if the distance d1 between discharge tips 121 of analogous adjacent electrodes 12 is longer, the flexible insulated member 11 and tip portion of electrode 12 do not require finish processing regardless of the configuration. In particular, the analogous adjacent discharge tips of flexible wire electrode in the charging member may be arranged so as to be mutually staggered in the direction of surface movement of the charge-receiving member. Furthermore, sprocket-like concavoconvexities may be formed in the flexible insulated member.

In the charging member 1 of FIG. 26, similar to that of FIG. 25, print signal s applied to mid stream electrodes and downstream electrodes must be delayed by time t2 and time t3, respectively, when the time t2 and time t3 are referred as print delay times between upstream electrode and midstream electrode, and between upstream electrode and downstream electrode, respectively. The times t2 and t3 are defined by the speed of travel of the surface of charge-receiving member, and the distances d2, d3 in the direction of the surface movement of the charge-receiving member between tips of upstream electrode and midstream electrode, and between tips of upstream electrode and downstream electrode. In this case, the peak voltage applied to charging member 1 can be reduced by setting the print pulse cycle time to a value that deviates from an integer multiple and 1/(integer multiple) of times t2 and t3 without overlapping the print signals applied to the electrodes. Peak voltage can also be desirably reduced by shifting the print signal by ⅓ the print pulse cycle time.

The charging member 1 of FIG. 26 is also provided with a conductive member 110 to provide smooth and reliable triboelectric charging and adhesion.

Figure 27A:
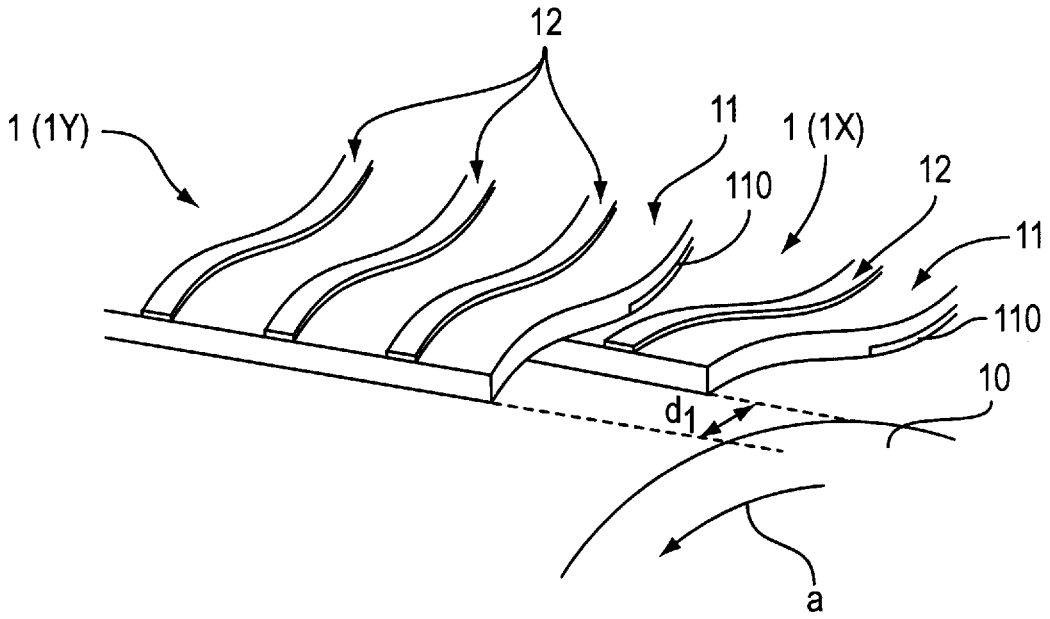
FIG. 27(A) is a perspective view of another embodiment of a plurality of charging members of the present invention.

FIG. 27(A) shows another charging member of the charging device of the present invention. In this example, a plurality of charging members 1 (i.e., two in this example) are provided. The plurality of charging members 1, each of which is provided with flexible wire electrodes 12 on flexible insulated member 11, are arranged so as to be staggered at intervals in the direction of surface movement of charge-receiving member 10. Each charging member 1 is provided with a conductive member 110 to provide smooth and reliable triboelectric charging and adhesion.

The electrodes 12 of the upstream charging member 1 (1X) and the electrodes 12 of downstream charging member 1 (1Y) are arranged so as to not overlap in the direction d4 of surface movement of charge-receiving member 10. The electrodes 12 of the downstream charging member 1Y are arrayed so as to correspond to intermediate positions between the electrodes 12 arrayed in a perpendicular direction relative to the direction of surface movement of charge-receiving member on upstream charging member 1X. Thus, overall, a doubled print density is realized over the print density of each flexible electrode 12 on the upstream side and the downstream side.

In the illustrated examples, the distance between the discharge tips of upstream charging member 1X and the discharge tips of the downstream charging member 1Y in the direction of the surface movement of the charge-receiving member is equivalent to [surface speed of the charge-receiving member (mm/sec)×t4 (sec)].

Similar to the charging member of FIG. 25, the print signal of the downstream electrodes 12 must be delayed by time t4 (seconds) relative to the print delay time t4 (seconds) between the upstream and downstream electrode tips 121. In this case, the peak voltage applied to charging member 1 can be reduced by setting the print pulse cycle time to a value that deviates from an integer multiple and 1/(integer multiple) of time t4 without overlapping the print signals applied to the upstream and downstream electrodes. Peak voltage can also be desirably reduced by shifting the print signal by one half the print pulse cycle time.

Although two charging members are used in this example, the print density is increased when three or more charging members are used.

Figure 27B:
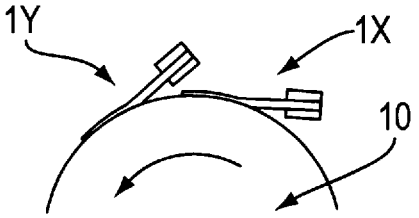
FIG. 27(B) is a side view of an arrangement of the same charging members shown in FIG. 27(A).
Figure 27C:
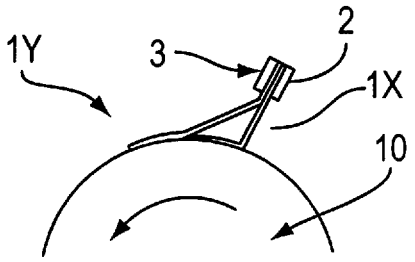
FIG. 27(C) is a side view of another arrangement of the charging members shown in FIG. 27(A).

The two charging members 1 may be arranged independently as shown in FIG. 27(B), or may be gripped together by a support member 12 and pressing member 3 as shown in FIG. 27(C). Alternatively, a single flexible insulated member 11 may be used which is provided with both upstream electrodes and downstream electrodes. The flexible insulated member 11 are folded so as to form two flexible insulated members comprising an upstream charging member 1X and downstream charging member 1Y, as shown in FIG. 27(D).

When separately supported as shown in FIG. 27(B), each charging member must be mounted with care due to the importance of precision positioning of each charging member relative to the direction perpendicular to the direction of the surface movement of the charge-receiving member.

Figure 27D:
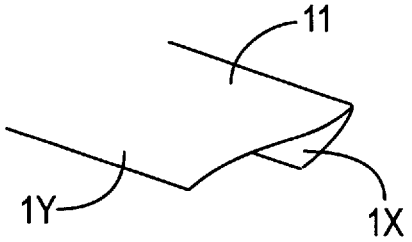
FIG. 27(D) is a perspective depiction of another arrangement of a plurality of charging members shown in FIG. 27(A).

When supported as shown in FIG. 27(C), or when formed as shown in FIG. 27(D), precision positioning of each charging member relative to a direction perpendicular to the direction of the surface movement of the charge-receiving member is determined at the time the charging member is attached to the support members, such that the operation of positioning when mounting the charging device is relatively easy.

The charging members shown in FIGS. 25, 26 and 27(A) through 27(D) may use one or more of the previously mentioned ventilation holes 13 and pressing fins 15.

Figure 28:
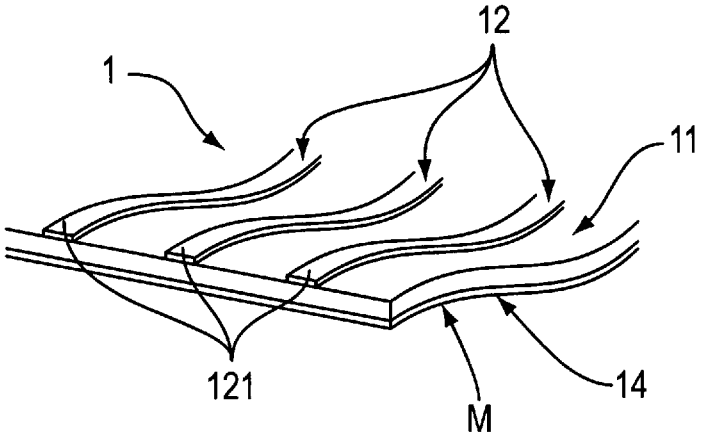
FIG. 28 is a perspective view showing part of another embodiment of the charging member of the present invention.

The present invention is not only applicable to the aforesaid modes of charging devices, but is also applicable to other modes of charging devices. FIG. 28 is a perspective view of part of another example of a charging member of the charging device of the present invention. This charging member 1 has a flexible semiconductive member 14 laminated on the bottom surface of flexible insulated member 11, which is designated as flexible intermediate member M. A plurality of flexible electrodes 12 are arrayed at predetermined intervals on the top surface of the intermediate member M, such that the semiconductive member 14 contacts charge-receiving member 10. Semiconductive member 14 is provided on the entire area of the bottom surface of flexible insulated member 11 in the present example. The semiconductive member 14 may be provided in the vicinity of the discharge tips 121 of electrodes 12, which must maintain a uniform distance between the electrodes 12 and the surface of the charge-receiving member.

The material of the semiconductive member may be a mixture of conductive materials and materials such as ethylene tetrafluoride resin, urethane rubber, polyamide, polyester and the like, but is not limited to the materials. Methods for forming the semiconductive member include liquid application, spattering and the like, but is not limited to the methods. The semiconductive member is an element that rubs the charge-receiving member and, therefore, it is desirable to use durable materials. Further, it is desirable to use material having a small friction coefficient relative to the charge-receiving member from the perspective of torque relative to the charge-receiving member. When the charge-receiving member is provided with a cleaning device, residual toner and the like used for developing may be returned to the charging device. Therefore, it is desirable that materials having excellent separation characteristics relative to the toner used for development are used to prevent fusion of the toner to the semiconductive member.

A resistance value in the range of about $10^2$ to about $10^8$ Ω•cm is suitable for the aforesaid semiconductive member.

A voltage is applied to the semiconductive member by a drive power unit not shown in the figures. It is desirable for the voltage level of the applied voltage to be a level which does not cause charging of the charge-receiving member via the semiconductive member, but is not limited to such a value. Although dependent on the material and resistance value of the semiconductive member, if the difference between the potential of the charge-receiving member and the voltage value applied to the semiconductive member is less than about 550 V, the charge-receiving member is not charged by the semiconductive member. Thus, if the potential of the charge-receiving member is zero (0 V), a suitable voltage applied to the semiconductive member is a value of about 550 to about 550 V. When a voltage is applied to the semiconductive member, the semiconductive member is adhered to the charge-receiving member via electrostatic attraction. As a result, a uniform discharge distance is maintained between the charge-receiving member 10 and the discharge tip 121 of electrode 12. Furthermore, soiling is prevented in the vicinity of the discharge area because foreign matter such as residual toner, transfer sheet debris and the like present on the surface of the charge-receiving member are intercepted upstream of the electrostatic adhesion area by the electrostatic attraction.

Figure 29:
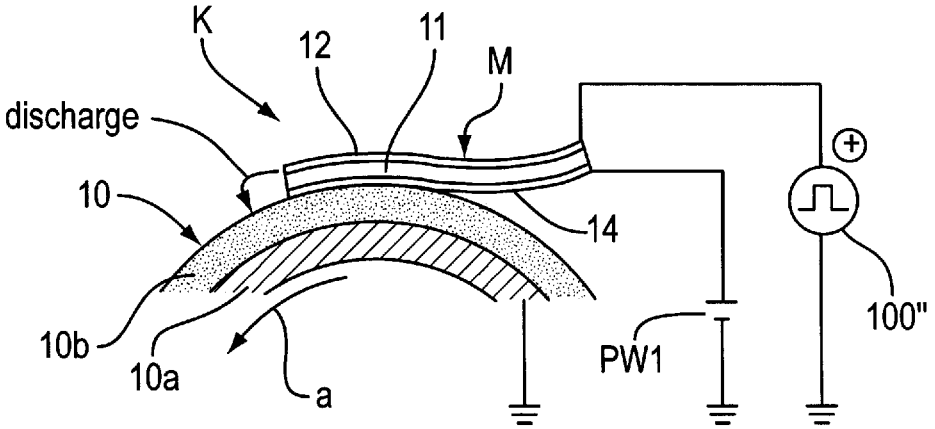
FIG. 29 shows the state of electrostatic adhesion in charging device using the charging member shown in FIG. 28, and shows the state of discharge from the electrodes.

FIG. 29 shows the state of electrostatic adhesion of charging member 1 on charge-receiving member 10 in a charging device K using the charging member 1 of FIG. 28, and shows the state of discharge from electrode 12 for printing. During discharge, a positive voltage sufficient to achieve discharge by flexible electrode 12 is applied from print voltage application unit 100". Semiconductive member 14 receives a positive voltage from power unit PW 1, and is attracted to charge-receiving member 10 via electrostatic force. Thus, there is a large difference in potential between electrode 12 and charge-receiving member 10 due to the difference in potential between electrode 12 and semiconductive member 14 during discharge, such that the discharge from electrode 12 is toward charge-receiving member 10 and produces excellent printing. If the difference in potential between electrode 12 and semiconductive member 14 is less than a discharge starting voltage, there is no discharge from electrode 12 toward semiconductive member 14, thereby reducing defective printing.

Figure 30:
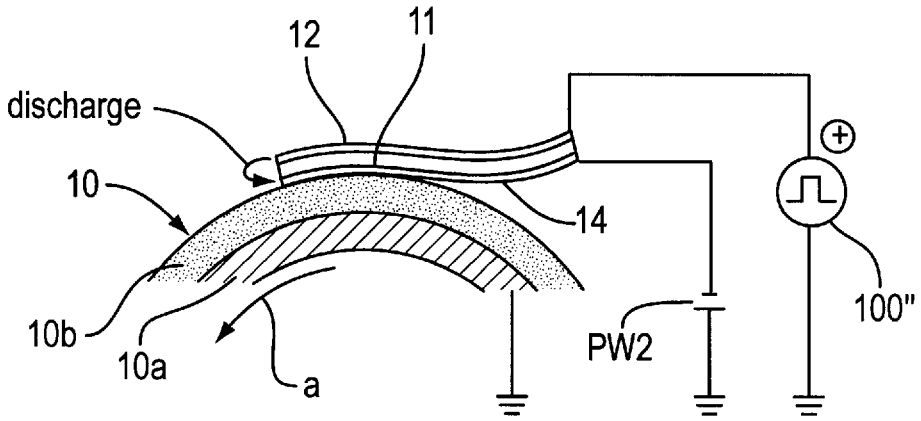
FIG. 30 is a reference illustration of a charging device that is different from that shown in FIG. 29.

FIG. 30 shows a charging device different than that of FIG. 29 for reference. In this charging device, a positive voltage is applied to flexible electrode 12 from print voltage application unit 100" during discharge, and a negative voltage is applied to semiconductive member 14 from power unit PW2. Accordingly, the difference in potential between electrode 12 and semiconductive member 14 becomes larger than the difference in potential between electrode 12 and charge-receiving member 10, such that a discharge readily occurs from electrode 12 to semiconductive member 14, and excellent printing cannot be attained.

In particular, if the polarity of the semiconductive member 14 relative to charge-receiving member 10 and the polarity of electrode 12 relative to charge-receiving member 10 are the same, then the difference in potential between electrode 12 and charge-receiving member 10 is greater than the difference in potential between electrode 12 and semiconductive member 14. As a result, excellent discharging is possible in a manner identical to the charging device of the present invention as described above.

If an electret member is used instead of a semiconductive member, a power source to form an electric field becomes unnecessary, thereby lowering costs. When an electret is used, excellent discharge is achieved from the electrode to the charge-receiving member similar to that previously described.

Figure 31A:
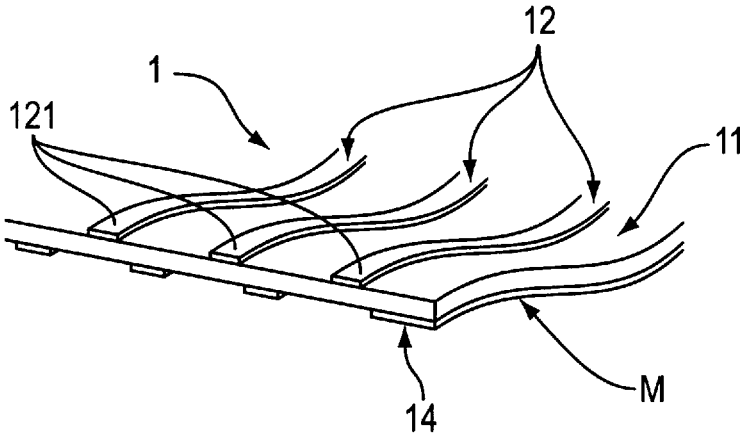
FIG. 31(A) is a perspective view of another embodiment of the charging ember of the present invention.
Figure 31B:
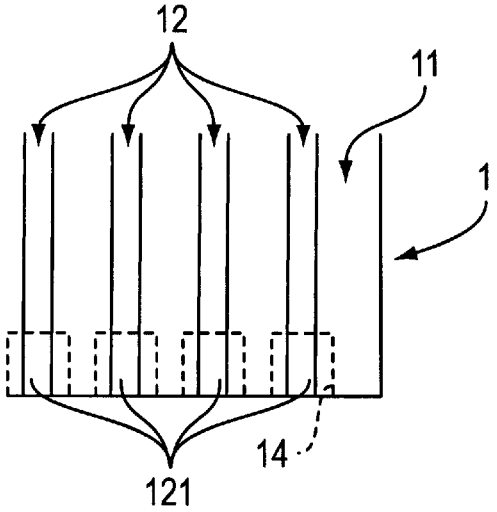
FIG. 31(B) is a plan view of the same charging member shown in FIG. 31(A), viewed from the electrode side.

FIG. 31(A) is a perspective view of another example of a charging member of the present invention. Flexible electrodes 12 are provided on one side of flexible insulated member 11, and a semiconductive member 14 is provided on the opposite side of flexible insulated member 11. The semiconductive members 14 are formed in a sprocket-like configuration (FIG. 31(B)) in the vicinity of discharge tips 121 of electrodes 12 with electrode tips 121 and semiconductive members 14 alternating. This arrangement prevents poor printing due to leaks by increasing the distance from tips 121 of electrodes 12 to semiconductive member 14, and producing electrostatic adhesion in the vicinity of discharge by electrode 12 necessary to maintain the uniform distance with charge-receiving member 10. According to the present invention, it is possible to reduce poor printing by setting the absolute value of the difference of the potential during discharge between the flexible electrode 12 and the potential in the vicinity of at least the discharge part of the flexible electrode 12 among parts of an intermediate member M. The intermediate member M comprises a flexible insulated member 11 and semiconductive member 14 which makes contact with the charge-receiving member 10 at a value less than the absolute value of the difference between the potential of flexible electrode 12 and the potential of charge-receiving member 10 during discharge.

Figure 32:
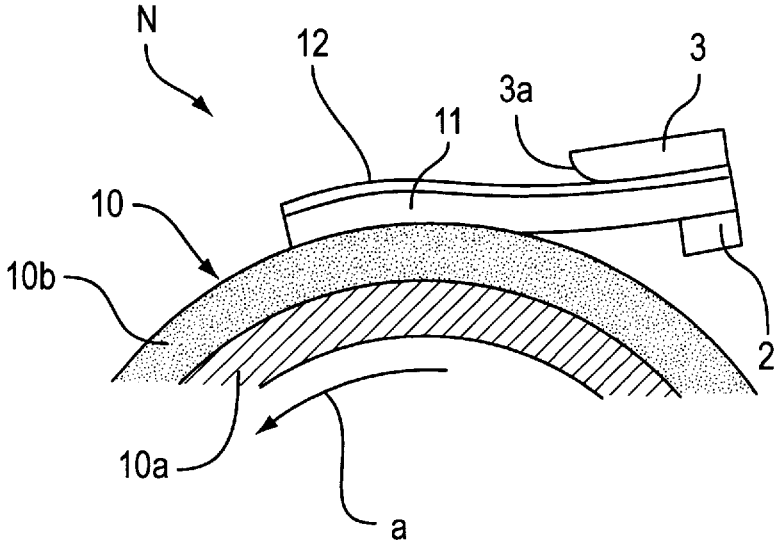
FIG. 32 is a brief side view showing another embodiment of the charging device of the present invention.

FIG. 32 is a brief side view showing another example of the charging device of the present invention. In this charging device N, flexible electrodes 12 are provided on one side of flexible insulated member 11. Charging member 1 is arranged along the direction of surface movement of charge-receiving member 10 similar to the arrangement in charging device A. The upstream edge in the direction of surface movement of the charge-receiving member is gripped between support member 2 and pressing member 3 which are arranged in parallel to the direction of the rotational axis of charge-receiving member 10, forming a cantilever support overall. Pressing member 3, however, is longer than support member 2 in the direction of surface movement of the charge-receiving member in this embodiment. Adhesion of flexible insulated member 11 to charge-receiving member 10 is increased by the attraction force produced by friction charging of flexible insulated member 11 and charge-receiving member 10.

A downstream edge 3*a* of pressing member 30 circumscribed on flexible insulated member 11 and is formed in an arced curved surface to prevent bending of the charging member and breakage of electrode 12 in contact with the edge of pressing member 30. When the radius of curvature R of this curved surface is large, it effectively prevents bending and breakage. Specifically, a radius of curvature R of about 0.5 mm or greater is desirable and a radius of about 2 mm or more is preferable.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. A charging device for charging a surface of a charge-receiving member that moves in a direction relative to said charging device, said charging device comprising:

an intermediate member having a first surface and a second surface, said first surface being for contacting the surface of said charge-receiving member and having an end portion at a downstream side of said first surface with respect to the moving direction, said second surface being located downstream of said charge-receiving member with respect to the moving direction and being extended from the end portion of said first surface in a direction substantially normal to the surface of the charge-receiving member, wherein the charge-receiving member is charged to a first polarity by contacting with said first surface;

an electrode provided for said charge-receiving member, said electrode having a tip located at said second surface; and a voltage source for applying electrical voltage to said electrode, the electrical voltage having a second polarity that is opposite to said first polarity.

2. The charging device as claimed in claim 1, wherein said intermediate member triboelectrically charges said charge-receiving member.

3. The charging device as claimed in claim 2, wherein said intermediate member has a conductive member.

4. The charging device as claimed in claim 3, wherein said conductive member overlaps a part of said first surface that comes in contact with the surface of said charge-receiving member with respect to the moving direction of said charge-receiving member.

5. The charging device as claimed in claim 3, wherein said conductive member is within about 5 mm of the upstream side of a part of said first surface that comes in contact with the surface of said charge-receiving member with respect to the moving direction of said charge-receiving member.

6. The charging device as claimed in claim 1, wherein a member made of a semiconductive material is provided on said first surface.

7. The charging device as claimed in claim 1, wherein a member made of an electret material is provided on said first surface.

8. The charging device as claimed in claim 1, wherein said electrode is provided with a plurality of liner electrodes.

9. The charging device as claimed in claim 8, wherein said voltage source applies the electric voltage to said liner electrodes in accordance with image signals.

10. The charging device as claimed in claim 1, wherein said intermediate member has a third surface which is opposite to said first surface, said electrode being disposed on said third surface and extending to said second surface.

11. The charging device as claimed in claim 1, wherein said electrode is provided in said intermediate member and projects from said second surface.

12. The charging device as claimed in claim 1, wherein said intermediate member is made of a flexible sheet-like material.

13. An image forming apparatus comprising:

a charge-receiving member that moves in a direction;

an intermediate member that is in contact with said charge-receiving member, said intermediate member being made of a material of which a rank of triboelectric series is different from that of said charge-receiving member, said intermediate member provided with an electrode for discharge to said charge-receiving member; and a voltage source connected to said electrode, said voltage source applying an electrical voltage having a first polarity to said electrode, wherein the absolute value of the difference between a potential of said electrode during application of the electrical voltage and a potential of said intermediate member is less than the absolute value of the difference between a potential of the charge-receiving member and the potential of the electrode during the electrical voltage application.

14. The image forming apparatus as claimed in claim 13, wherein said intermediate member is made of a flexible material.

15. The image forming apparatus as claimed in claim 13, wherein said intermediate member is triboelectrically charged to said first polarity and said charge-receiving member is triboelectrically charged to a second polarity that is opposite to said first polarity by the friction therebetween.

16. An image forming apparatus comprising:

a charge-receiving member that moves in a direction;

an intermediate member that is in contact with said charge-receiving member, said intermediate member being made of a material of which a rank of triboelectric series is different from that of said charge-receiving member;

said member provided with an electrode for discharge to said charge-receiving member, and at least a part of the intermediate member being located between the electrode and the surface of the charge-receiving member to provide a gap therebetween, wherein said electrode comprises a plurality of liner electrodes.

17. The image forming apparatus as claimed in claim 16, wherein said intermediate member is made of a flexible material.

18. The image forming apparatus as claimed in claim 16, wherein said charge-receiving member is triboelectrically charged to a first polarity and said intermediate member is triboelectrically charged to a second polarity that is opposite to said first polarity by friction therebetween.

19. The image forming apparatus as claimed in claim 18, further comprising, a voltage source that is connected to said liner electrodes, said voltage source applying an electrical voltage having said second polarity to said liner electrodes.

20. An image forming apparatus comprising:

a charge-receiving member which moves;

an intermediate member that is in contact with said charge-receiving member, said intermediate member provided with an electrode; and a voltage source that is connected with said electrode for applying an electrical voltage to the electrode, said electrode for discharging to a surface of said charge-receiving member in accordance with the voltage application, wherein the absolute value of the difference between the potential of said electrode during the voltage application and the potential of said intermediate member is less than the absolute value of the difference between the potential of the charge-receiving member and the potential of the electrode during the voltage application.

21. The image forming apparatus as claimed in claim 20, wherein the difference between the potential of said electrode during the voltage application and the potential of said intermediate member is less than a discharge starting voltage.

22. The image forming apparatus as claimed in claim 20, wherein said electrode comprises a plurality of liner electrodes.

23. The image forming apparatus as claimed in claim 20, wherein said intermediate member is made of a flexible material.

24. The image forming apparatus as claimed in claim 20, wherein said charge-receiving member is triboelectrically charged to a first polarity and said intermediate member is triboelectrically charged to a second polarity that is opposite to said first polarity by friction therebetween.

25. The image forming apparatus as claimed in claim 20, further comprising, a semiconductive material that is provided on a surface of said intermediate member that comes in contact with said charge-receiving member.

26. The image forming apparatus as claimed in claim 20, further comprising, an electret material that is provided on a surface of said intermediate member that comes in contact with said charge-receiving member.

* * * * *